US007561151B2

(12) United States Patent
Cho et al.

(10) Patent No.: US 7,561,151 B2
(45) Date of Patent: Jul. 14, 2009

(54) METHOD OF DRIVING PLASMA DISPLAY PANEL

(75) Inventors: Ki Duck Cho, Changwon-si (KR); Min Soo Kim, Gumi-si (KR); Won Jae Kim, Masan-si (KR); Kyoung Jin Jung, Gumi-si (KR); Byung Hyun Kim, Gumi-si (KR)

(73) Assignee: LG Electronics Inc., Seoul (KR)

( * ) Notice: Subject to any disclaimer, the term of this patent is extended or adjusted under 35 U.S.C. 154(b) by 658 days.

(21) Appl. No.: 11/289,415

(22) Filed: Nov. 30, 2005

(65) Prior Publication Data

US 2006/0164342 A1 Jul. 27, 2006

(30) Foreign Application Priority Data

Dec. 1, 2004 (KR) ..... 10-2004-0100090
Feb. 23, 2005 (KR) ..... 10-2005-0015125

(51) Int. Cl.
*G09G 5/00* (2006.01)

(52) U.S. Cl. ..... 345/204; 345/209; 345/212

(58) Field of Classification Search ..... 345/60–69, 345/204, 92, 209, 96, 212, 690; 257/146; 368/6; 313/581, 582, 587; 315/169.1–169.4
See application file for complete search history.

(56) References Cited

U.S. PATENT DOCUMENTS 4,022,017 A * 5/1977 Aoki et al. ..... 368/6
4,157,231 A * 6/1979 Phillips ..... 408/1 R
6,417,824 B1 * 7/2002 Tokunaga et al. ..... 345/60
6,448,960 B1 * 9/2002 Shigeta ..... 345/204
6,496,165 B1 * 12/2002 Ide et al. ..... 345/60
6,614,413 B2 * 9/2003 Tokunaga et al. ..... 345/63
6,778,152 B1 * 8/2004 Huang ..... 345/60
6,963,320 B2 * 11/2005 Kanazawa ..... 345/60
2001/0045924 A1 * 11/2001 Huang ..... 345/63
2002/0003515 A1 * 1/2002 Lee et al. ..... 345/60
2002/0054000 A1 * 5/2002 Tokunaga et al. ..... 345/60
2003/0006945 A1 * 1/2003 Lim et al. ..... 345/67
2004/0051689 A1 * 3/2004 Nakamura et al. ..... 345/89
2004/0066394 A1 * 4/2004 Tokunaga et al. ..... 345/690
2004/0212563 A1 * 10/2004 Kang et al. ..... 345/60
2005/0068264 A1 * 3/2005 Yahagi ..... 345/60
2005/0134532 A1 * 6/2005 Choi et al. ..... 345/60

FOREIGN PATENT DOCUMENTS

KR 10-2000-0053573 A 8/2000
KR 10-2001-0004132 A 1/2001

OTHER PUBLICATIONS

Korean Office Action dated Jul. 24, 2006.

* cited by examiner

*Primary Examiner*—Prabodh M. Dharia
(74) *Attorney, Agent, or Firm*—Ked & Associates, LLP

(57) ABSTRACT

A method of driving a plasma display device having a plurality of scan electrode lines divided into the m (m is an integer greater than 2) number of groups, includes: applying p (p is a natural number greater than 1) number of first reset pulse having a first voltage to the scan electrode lines included in more than one group among the m number of groups during a specific frame; and simultaneously applying q (q is a natural number greater than 1) number of second reset pulse having a second voltage different from the first voltage to the second electrode line included in the rest groups except for the more than one group during the specific frame.

19 Claims, 18 Drawing Sheets

METHOD OF DRIVING PLASMA DISPLAY PANEL

This application claims the benefit of Korean Patent Application No. P2005-15125 filed on Feb. 23, 2005 and Korean Patent Application No. 2004-100090 filed on Dec. 1, 2004, which are hereby incorporated by reference.

BACKGROUND OF THE INVENTION

1. Field of the Invention

The present invention relates to a plasma display panel, and more particularly, to a method of driving plasma display panel.

2. Description of the Related Art

Recently, a plasma display panel (hereinafter, referred to as "PDP") has been the center of attention as a flat panel display since it is easy to be made into a large-sized panel. The PDP generally displays a picture by controlling the gas discharge period of each pixel in accordance with digital video data. Such a PDP includes three electrodes as in FIG. 1, and is typically an AC type of PDP which is driven by AC voltage.

FIG. 1 illustrates a magnified discharge cell that constitutes a general AC type PDP. A discharge cell 30 shown in FIG. 1 includes an upper plate having a scan electrode 12A, a sustain electrode 12B, an upper dielectric layer 14 and a protective film 16 which are sequentially formed on an upper substrate 10; and a lower plate having an address electrode 20, a lower dielectric layer 22, barrier ribs 24 and a phosphorus layer 26 that are sequentially formed on a lower substrate 18.

Each of the scan electrode 12A and the sustain electrode 12B includes a transparent electrode and a metal electrode that is for compensating the high resistance of the transparent electrode. The scan electrode 12A supplies a scan signal for address discharge and a sustain signal for sustain discharge. The sustain electrode 12B mainly supplies a sustain signal. The address electrode 20 is formed to cross the scan electrode 12A and the sustain electrode 12B. The address electrode 20 supplies a data signal for address discharge.

Electric charges generated by the discharge are accumulated at the upper dielectric layer 14 and the lower dielectric layer 22. The protective film 16 prevents the damage of the upper dielectric layer 14 caused by sputtering and increases the emission efficiency of secondary electrons. The dielectric layers 14, 22 and the protective film 16 enable to reduce the discharge voltage applied from the outside.

The barrier ribs 24 provide a discharge space together with the upper and lower substrates 10 and 18. And the barrier ribs 24 are formed in parallel to the address electrode 20 to prevent the ultraviolet ray generated by the gas discharge from leaking to adjacent cells.

The phosphorus layer 26 is spread over the surface of the lower dielectric layer 22 and the barrier ribs 24 to generate red, green and blue visible rays. The discharge space is fully filled up with an inert gas such as He, Ne, Ar, Xe, Kr, a mixture discharge gas of the above gases or an excimer gas that can generate ultraviolet ray by discharge, for gas discharge.

The discharge cell 30 of such a structure sustains the discharge in a surface discharge by the scan electrode 12A and the sustain electrode 12B after being selected as an opposite discharge by the address electrode 20 and the scan electrode 12A. Accordingly, a visible ray is emitted at the discharge cell 30 by having the phosphorus 26 emit light by the ultraviolet ray that is generated upon sustain discharge.

In case of this, the discharge cell 30 controls a sustain discharge period, i.e., the number of sustain discharge, in accordance with the video data to realize the gray scale required for image display. And, the color of one pixel is realized by compounding three discharge cells where each of red, green and blue phosphorus 26 is coated.

FIG. 2 illustrates a driving waveform of the related art PDP. As shown in FIG. 2, the PDP is driven in the manner of dividing one frame into an initialization period to initialize a full screen, an address period to select cells and a sustain period to sustain the discharge of the selected cells.

In the initialization period, a rising ramp waveform Ramp-up is simultaneously applied to all scan electrodes Y during a set-up interval SU. The rising ramp waveform Ramp-up causes a dark discharge within the cells of the full screen. The setup discharge causes positive wall charges to be accumulated in an address electrode X and a sustain electrode Z, and negative wall charges to be accumulated in a scan electrode Y.

During a set-down interval SD, a falling ramp waveform Ramp-down is applied to the scan electrodes Y. The falling ramp waveform Ramp-down falls from a positive voltage lower than a peak voltage of the rising ramp waveform Ramp-up up to the ground voltage GND or a specific negative voltage level, to thereby eliminate some of excessive wall charges formed within the cells. The wall charges to the extent that an address discharge might be stably generated are remained within the cells by the falling ramp pulse Ramp-down.

In the address period, a scan pulse Scan is sequentially applied to the scan electrodes Y and at the same time data pulses data synchronized with the scan pulses Scab are applied to the address electrodes X.

When the voltage difference between the scan pulse Scan and the data pulse data is added to the wall voltages generated in the initialization period, the address discharge is generated within the cell to which the data pulse data is applied. When sustain voltages are applied, wall charges to the extent that the discharge might be generated are formed within the cells selected by the address discharge.

A bias voltage Zdc is applied to the sustain electrode Z so as not to be generated a mis-discharge between the scan electrode Y and the sustain electrode Z by reducing a voltage difference between the sustain electrode Z and the scan electrode during the set-down interval SD and the address period.

In the sustain period, sustain pulses Sus are alternately applied to the scan electrodes Y and the sustain electrodes Z. In the cells selected by the address discharge, a sustain discharge, i.e., display discharge, is generated between the scan electrode Y and the sustain electrode Z whenever each sustain pulse Sus is applied as the wall voltage within the cell is added to the sustain pulse Sus.

After the completion of the sustain discharge, a ramp waveform Ramp-era having a low pulse width and a low voltage level is supplied to the sustain electrode Z to erase the wall charge remaining within the cells.

FIG. 3 is a circuit diagram of the related art scan electrode driver. The scan electrode driver of the related art plasma display panel generates a rising ramp pulse Ramp-up and a falling ramp pulse Ramp-down in an initialization period.

First of all, a set-up switch Q5 and a seventh switch Q7 are turned on during the initialization period. At this time, a sustain voltage Vs is applied from a sustain pulse supplier 40. The sustain voltage Vs is supplied to scan electrodes via a body diode of a sixth switch Q6, the seventh switch Q7, and a scan IC 48.

In this case, since the sustain voltage Vs is applied to a negative terminal of a second capacitor C2, the second capacitor C2 supplies the sum(Vs+Vsetup) of the sustain voltage and the set-up volage to the fifth switch Q5.

The fifth switch Q5 supplies a voltage, having a predetermined inclination and applied from the second capacitor C2, to a first node point n1, by a first variable resistance VR1 and a third capacitor C2, which are installed at a previous stage of the fifth switch Q5.

The voltage, having the predetermined indication and applied to the first node point n1, is applied to the scan electrode via the seventh switch Q7 and the scan IC 48. Thus, the rising ramp pulse Ramp-up is applied to the scan electrodes.

After the rising ramp pulse Ramp0up is applied to the scan electrode, the fifth switch Q5 is turned off. If the fifth switch Q5 is turned off, then only Vs voltage supplied from the sustain pulse supplier 40 is applied to the first node point n1. Accordingly, voltages of the scan electrode and the sustain electrode fall to the Vs.

Thereafter, the seventh switch Q7 is turned off and a tenth switch 10 is turned on in the set-down interval SD. The tenth switch Q10 adjusts a channel width by a second variable resistance VR2 installed at a previous stage thereof, and falls a voltage of a second node n2, which the voltage has a predetermined inclination, to a writing scan voltage −V2. At this time, the falling ramp pulse Ramp-down is applied to the scan electrode.

However, in the related art driving waveform, a reset pulse of a high voltage is applied in a reset interval of each sub-field, so that a dark discharge is generated. Preferably, light should not be emitted in the reset interval. But, light is emitted due to the dark discharge caused by the reset pulse.

The generation of the light caused by the dark discharge is a main factor obstructing an improvement of contrast ratio of the plasma display panel, and a low contrast ratio reduces a distinctive degree of the plasma display panel.

SUMMARY OF THE INVENTION

Accordingly, it is an object of the present invention to provide a plasma display device and a method of driving the same that is capable of applying a high contrast ratio.

In order to achieve these and other objects of the invention, a method of driving a plasma display device driven by dividing a plurality of scan electrode lines into the m (m is a integer more than 2) number of groups, according to the present invention includes: applying p (p is a natural number more than 1) number of first reset pulse having a first voltage to the scan electrode lines included in more than one group among m number of groups during a specific frame; and simultaneously applying q (q is a natural number more than 1) number of second reset pulse having a second voltage different from the first voltage to the second electrode line included in the rest groups except for more than one group during the specific frame.

A method of driving a plasma display panel, initializing a discharge cell by using an initializing signal for causing a set-up discharge, according to the present invention includes: applying the initializing signal of a high voltage to at least one scan electrode during one frame period; and applying the initializing signal of a low voltage to the rest scan electrodes except for the scan electrodes to which the initializing signal of the high voltage is applied during the frame period.

An apparatus of driving a plasma display panel driven by dividing a plurality of scan electrode lines into the m (m is an integer more than 2) number of groups, according to the present invention includes a reset driving circuit including: generating the p (p is a natural number more than 1) number of first reset pulse having a first voltage to apply them to the scan electrode lines included in more than one group among m number of groups during a specific frame; and generating the q (q is a natural number more than 1) number of second reset pulse having a second voltage different from the first voltage to apply them to the second electrode line included in the rest groups except for more than one group during the specific frame.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Reference will now be made in detail to the preferred embodiments of the present invention, examples of which are illustrated in the accompanying drawings.

Hereinafter, the preferred embodiments of the present invention will be described in detail with reference to FIGS. 4 to 18.

Figure 4:
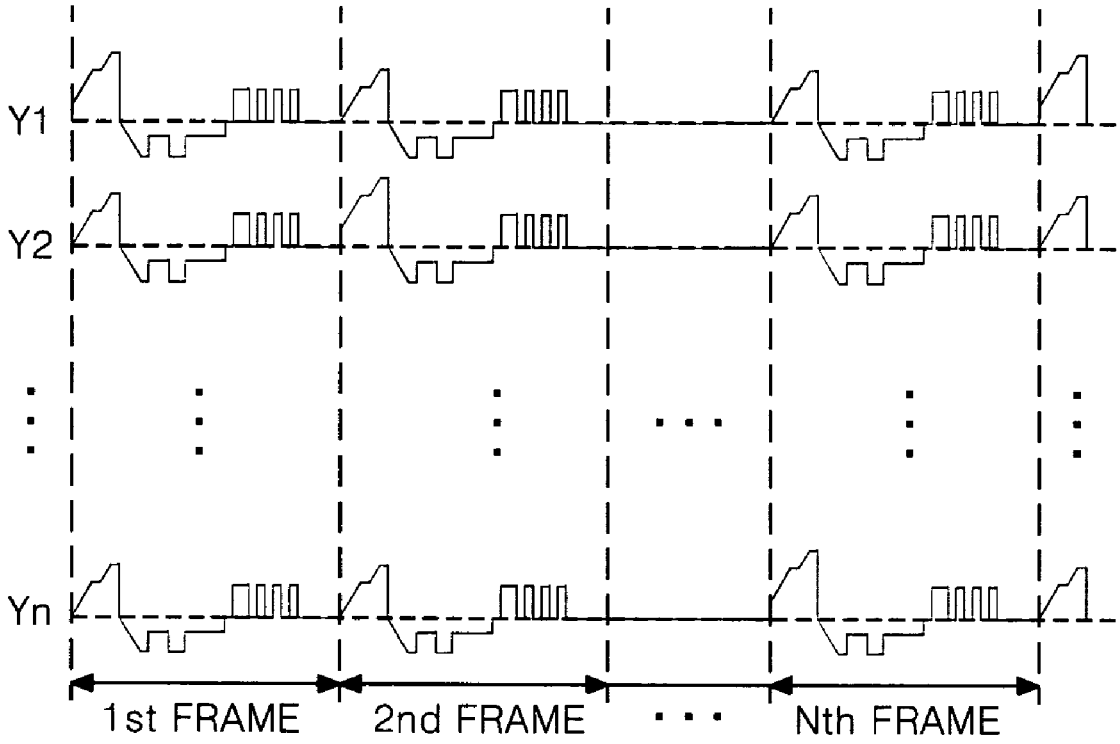
FIG. 4 is a waveform diagram in accordance with a method of driving PDP according to a first embodiment of the present invention.

FIG. 4 is a waveform diagram in accordance with a method of driving PDP according to a first embodiment of the present invention. As shown in FIG. 4, a scan electrode is divided into m number of groups, a strong discharge reset pulse is applied to a scan electrode belong to each group in any one frame among n number of frames 1st to Nth frame, and a weak discharge reset pulse is applied to the rest frame. Herein, the frames in which the strong reset pulse is scan electrode belong to each group are different each other.

In this case, it is preferable that a sequence of the frames in which the strong reset pulse is applied is the same as a sequence of the groups. In other words, it is preferable that the strong discharge pulse is applied to the $1^{st}$ frame in the scan electrode belong to the first group, the strong discharge pulse is applied to the $2^{nd}$ frame in the scan electrode belong to the second group, and the strong discharge pulse is applied to the Nth frame in the scan electrode belong to the Nth group.

Since such a strong discharge reset pulse is applied to only one frame in the N number of frames, not is applied to the scan electrode for each frame, a contrast ratio is largely increased as compared to the related art driving method.

Figure 5:
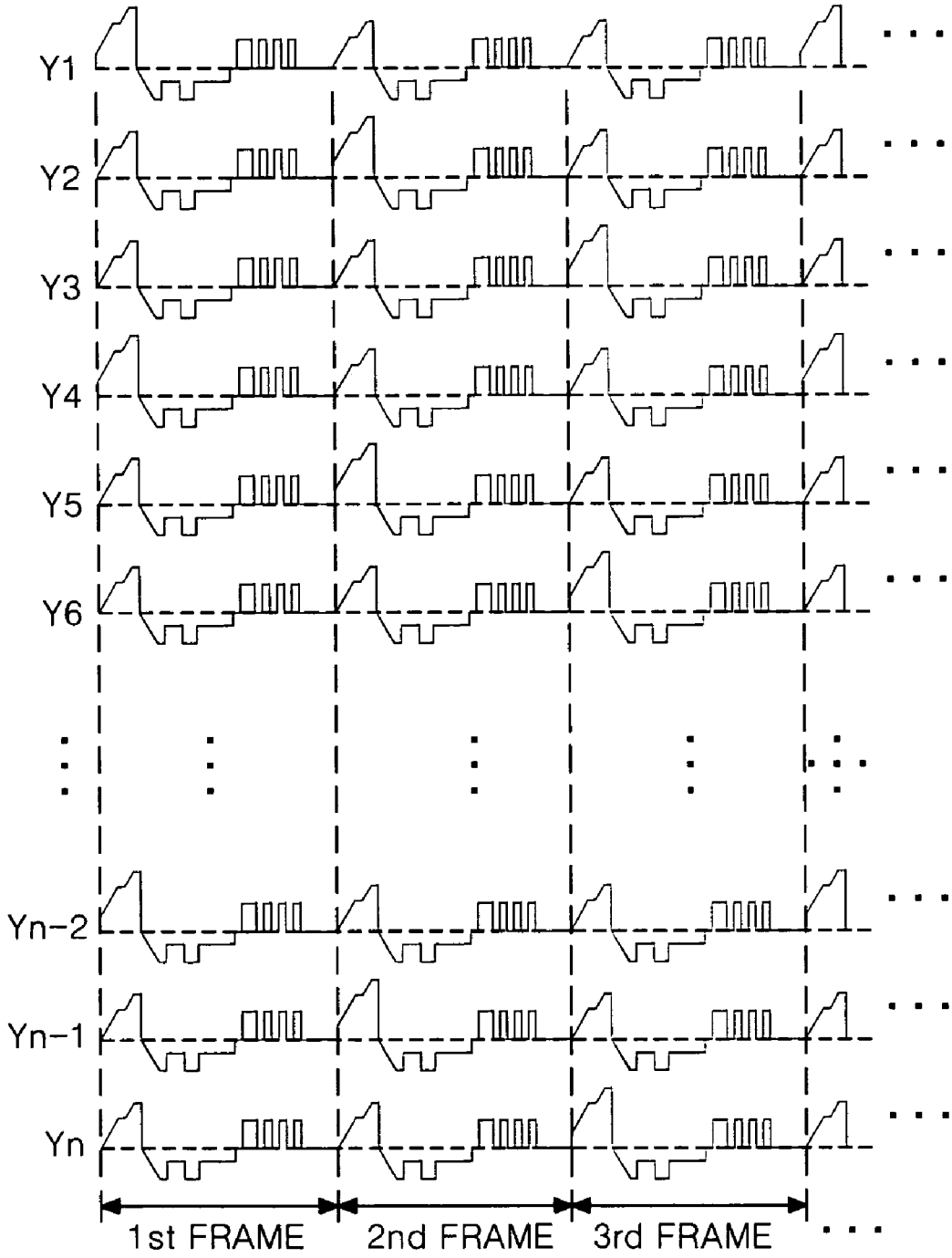
FIG. 5 is a waveform diagram of the time when a scan electrode is divided into three groups to apply the method of driving PDP according to the present invention.

FIG. 5 is a waveform diagram of the time when a scan electrode is divided into three groups to apply the method of driving PDP according to the present invention. As shown in FIG. 5, when the scan electrode is divided into three groups (m=3), Y1, Y4, Y7, . . . Yn−2 become a first group, Y2, Y5, Y8, . . . Yn−1 become a second group, and Y3, Y6, Y9, . . . Yn become a third group.

In scan electrodes Y1, Y4, Y7, . . . Yn−2 belong to the first group, a strong discharge pulse is applied to the 1st frame among three frames, and a weak discharge reset pulse is applied to the 2nd frame and the 3rd frame.

In scan electrodes Y2, Y5, Y8, . . . Yn−1 belong to the second group, a strong discharge pulse is applied to the 2nd frame among three frames, and a weak discharge reset pulse is applied to the 1st frame and the 3rd frame.

In scan electrodes Y3, Y6, Y9, . . . Yn belong to the third group, a strong discharge pulse is applied to the 3rd frame among three frames, and a weak discharge reset pulse is applied to the 1st frame and the 2nd frame.

It is possible that a strong discharge reset pulse is applied to the $3^{rd}$ frame in the scan electrodes Y1, Y4, Y7, . . . Yn−2 belong to the first group, a strong discharge reset pulse is applied to the $2^{nd}$ frame in the scan electrodes Y2, Y5, Y8, . . . Yn−1 belong to the second group, and a strong discharge reset pulse is applied to the $1^{st}$ frame in the scan electrodes Y3, Y6, Y9, . . . Yn belong to the third group.

In other words, it is preferable that the frames to which a strong discharge reset pulse is applied in the scan electrodes belong to each group area different each other, and the sequence of the frames to which a strong discharge reset pulse is applied is the same as the sequence of the groups.

It is possible that such a driving method is applied to an extension of one frame.

In other words, a plurality of scan electrodes is divided into m number of groups, wherein m is an integer more than 2, to be driven, p number of strong discharge reset pulse having a first voltage is applied to the scan electrodes belong to more than one group among m number of groups during a specific frame, wherein p is a natural number more than 1, and q number of weak discharge reset pulse having a second voltage different from the first voltage is simultaneously applied to the scan electrodes belong to the rest groups except for more than one group to which the strong discharge reset pulse is applied during the specific frame, wherein q is a natural number more than 1.

In other words, a strong discharge reset pulse is applied to more than one group during a specific frame having 10 sub-fields or 12 sub-fields in a reset interval of each of p number of sub-fields. Further, if a strong discharge reset pulse is applied to more than one group during one frame, then a weak discharge reset pulse is simultaneously applied to the rest groups in a reset interval of each of q number of sub-fields.

It is possible that the present invention is applied to an extension of not only one frame but also next frame.

That is, a strong discharge reset pulse is applied to the scan electrodes belong to more than one among m number of groups during a specific frame, a weak discharge reset pulse is applied to the scan electrodes belong to the rest groups, a strong discharge reset pulse is applied to the scan electrodes, belong to more than one group to which the strong discharge reset pulse is applied, after more than one frame in the specific frame, and a strong discharge reset pulse is applied to the scan electrodes, belong to the group to which the weak discharge reset pulse is applied, from the next frame of the specific frame.

In other words, if a strong discharge reset pulse is applied to more than one group during a specific frame, then a weak discharge reset pulse is applied to more than one group, to which the strong discharge reset pulse was applied, in the next time.

Thus, a strong discharge reset pulse is applied to any one group of the rest groups except for more than one group, to which the strong discharge reset pulse was applied, and a weak discharge reset pulse is applied to the rest groups, during the next frame of the specific frame. In this connection, the rest groups also include more than one group, to which a strong discharge reset pulse is applied, in the specific frame.

Figure 6:
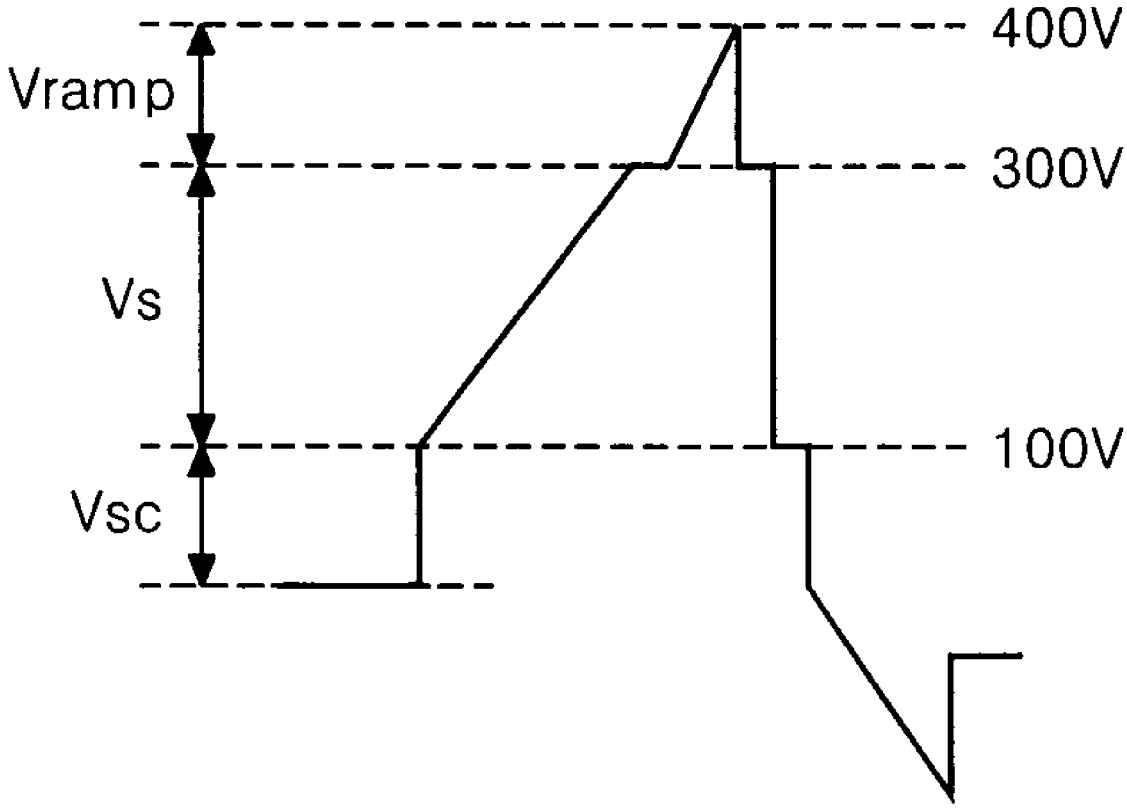
FIG. 6 is a waveform diagram showing a strong discharge reset pulse of the PDP according to the present invention.
Figure 7:
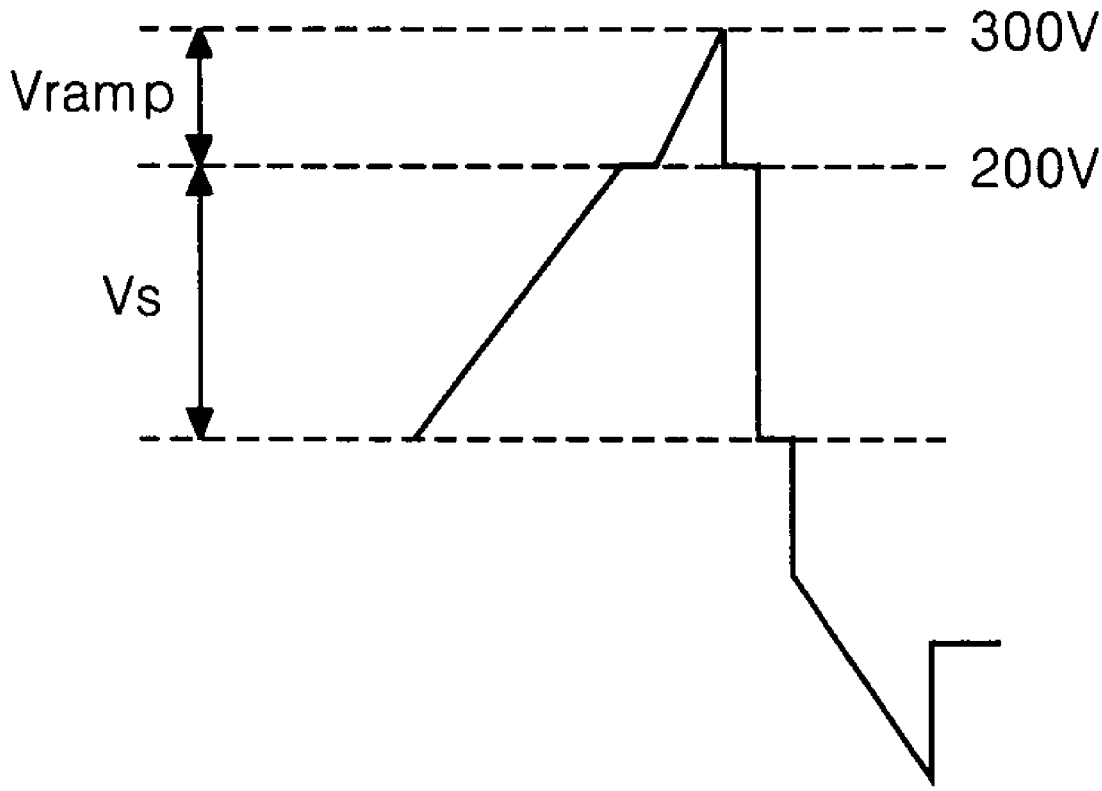
FIG. 7 is a waveform diagram showing a weak discharge reset pulse of the PDP according to the present invention.
Figure 8:
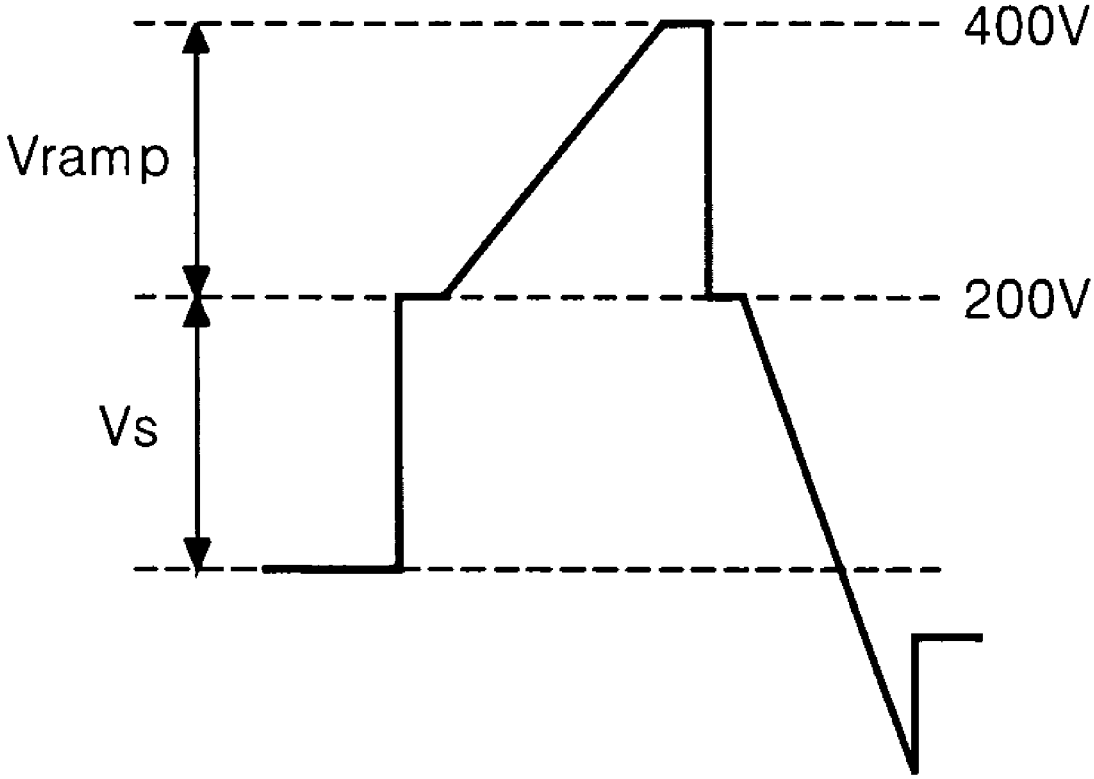
FIG. 8 is a waveform showing a general reset pulse.

FIG. 6 is a waveform diagram showing a strong discharge reset pulse of the PDP according to the present invention, FIG. 7 is a waveform diagram showing a weak discharge reset pulse of the PDP according to the present invention, and FIG. 8 is a waveform showing a general reset pulse.

As shown in FIG. 6, a strong discharge reset pulse used in the driving method of the present invention had been already scanned in the address period or suddenly rises to a scan bias voltage Vsc applied to scan electrodes, to which a scan is not performed. Thereafter, the strong discharge reset pulse rises to the sum of the scan bias voltage Vsc and the sustain voltage Vs by a first inclination, maintains the sum of the scan bias voltage Vsc and a sustain voltage Vs, and rises to the sum of the scan bias voltage Vsc, the sustain voltage Vs and a ramp voltage Vramp by a second inclination.

In this connection, the scan bias voltage Vsc is 100V, the sustain voltage Vs is 200V, and the ramp voltage is 100V. Thus, the strong discharge reset pulse used in the driving method of the present invention rises up to 400V. Further, the first inclination and the second inclination are the same each other.

Figure 1:
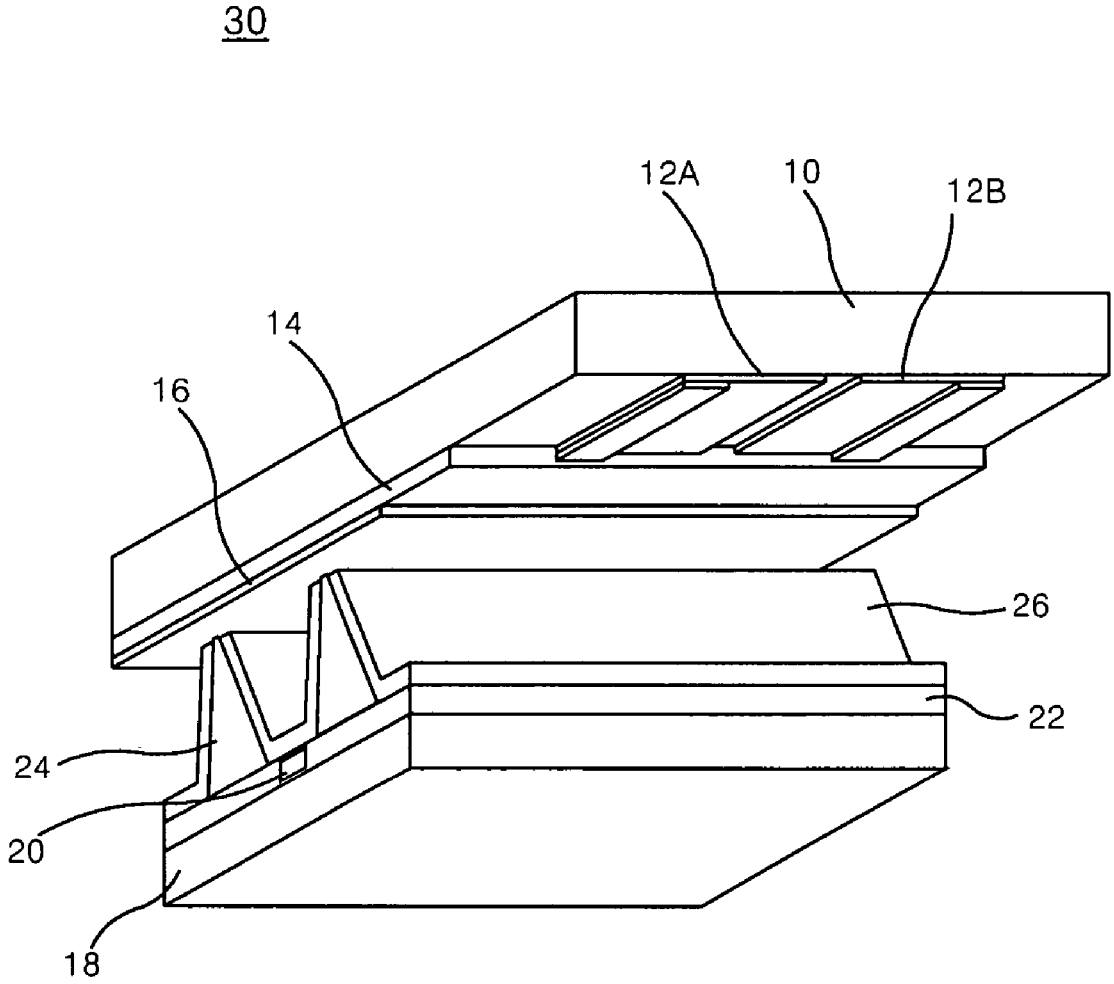
FIG. 1 RELATED ART
FIG. 1 illustrates a magnified discharge cell that constitutes a general AC type PDP.
Figure 2:
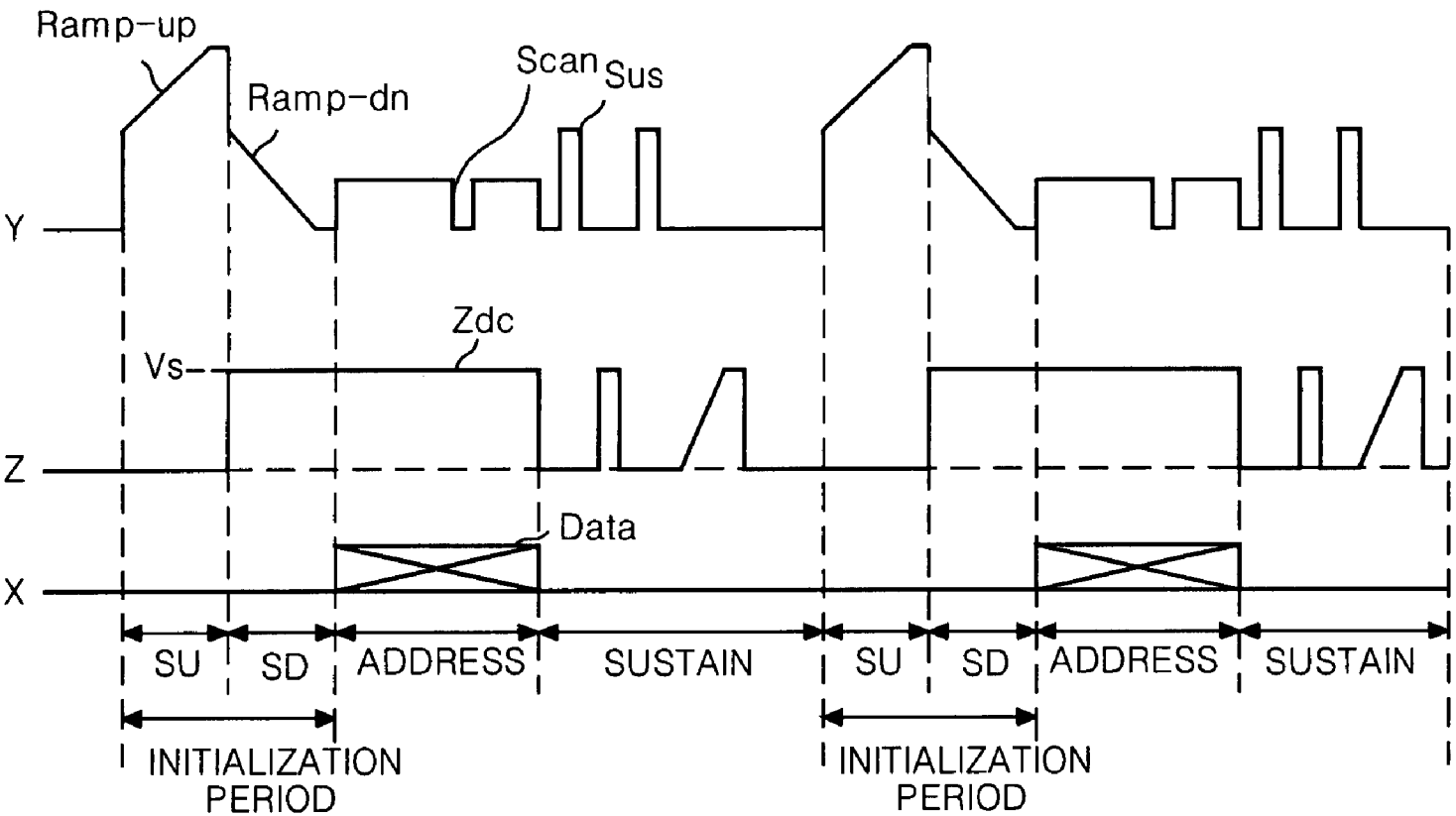
FIG. 2 RELATED ART
FIG. 2 illustrates a driving waveform of the related art PDP.
Figure 3:
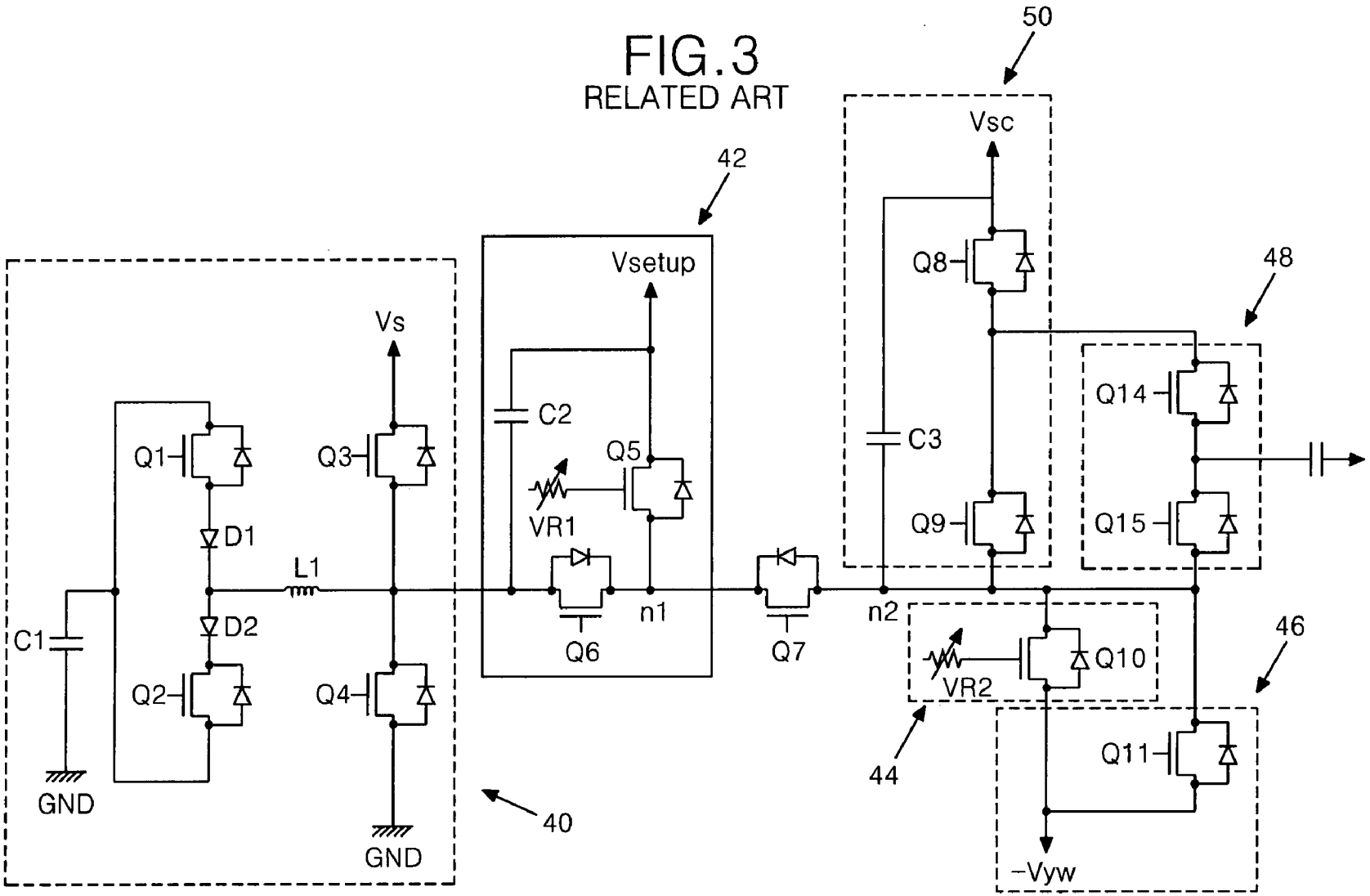
FIG. 3 RELATED ART
FIG. 3 is a circuit diagram of a scan electrode driver of the related art PDP.

The formation of the strong discharge pulse and the weak discharge pulse is implemental by using the related art driving circuit shown in FIG. 3 instead of a new driving circuit.

First of all, the scan bias voltage Vsc is applied to a panel C by a turn-on of both a switch Q8 and a switch Q14. Accordingly, a potential of the scan electrode suddenly rises from OV to 100V, that is, the scan bias voltage Vsc.

Next, a switch Q3 and a switch Q5 are turned on to apply the sustain voltage Vs to the scan electrode. In this connection, since the switch Q5 is operated in an active area, the potential of the scan electrode rises which having the first inclination. Thus, the potential of the scan electrode is the sum of the scan bias voltage Vsc and the sustain voltage Vs. In this case, the scan bias voltage Vsc is 100V, the sustain voltage Vs is 200V, so that the potential of the scan electrode rises up to 300V.

Sequentially, a set-up voltage Vsetup for forming the related art rising ramp pulse Ramp-up is applied to the scan electrode via the switch Q5. Thus, the potential of the scan electrode is the sum of the scan bias voltage Vs, the sustain voltage Vs and the ramp voltage Vramp. In other words, the potential of the scan electrode rises from 300V to 400V which having the second inclination. In this case, the first inclination and the second inclination are the same. The ramp voltage Vramp is formed by the set-up voltage Vsetup.

As shown in FIG. 8, the set-up voltage Vsetup is 200V. Accordingly, the related art reset pulse rises to 400V, that is the sum of the set-up voltage Vsetup and the sustain voltage Vs.

If the set-up voltage Vsetup is used as it is to form the strong discharge reset pulse of the present invention, then the strong discharge reset pulse rises up to 500V(=Vsc+Vs+Vsetup). If the strong discharge reset pulse rises up to 500V, then a voltage more than a standard is added. Accordingly, a discharge characteristic becomes deteriorated.

Thus, in order to form the strong discharge reset pulse according to the driving method of the present invention, the potential of the scan electrode rises from the sum of the scan bias voltage Vsc and the sustain voltage Vs with the second inclination up to 400V by blocking a supply of the set-up voltage Vsetup.

The weak discharge pulse is directly formed by the sum of the sustain voltage Vs and the ramp voltage Vramp without applying the scan bias voltage Vsc in the formation process of the strong discharge pulse as described above.

In other words, the potential of the scan electrode rises to the sustain voltages Vs which having a third inclination, and then again rises to the sum of the sum of the sustain voltage Vs and the ramp voltage Vramp which having a fourth inclination, to thereby form the weak discharge pulse.

In this case, the third inclination is the same as the first inclination, and the fourth inclination is the same as the second inclination. It is mostly preferable that the first inclination is the same as the fourth inclination.

Figure 9:
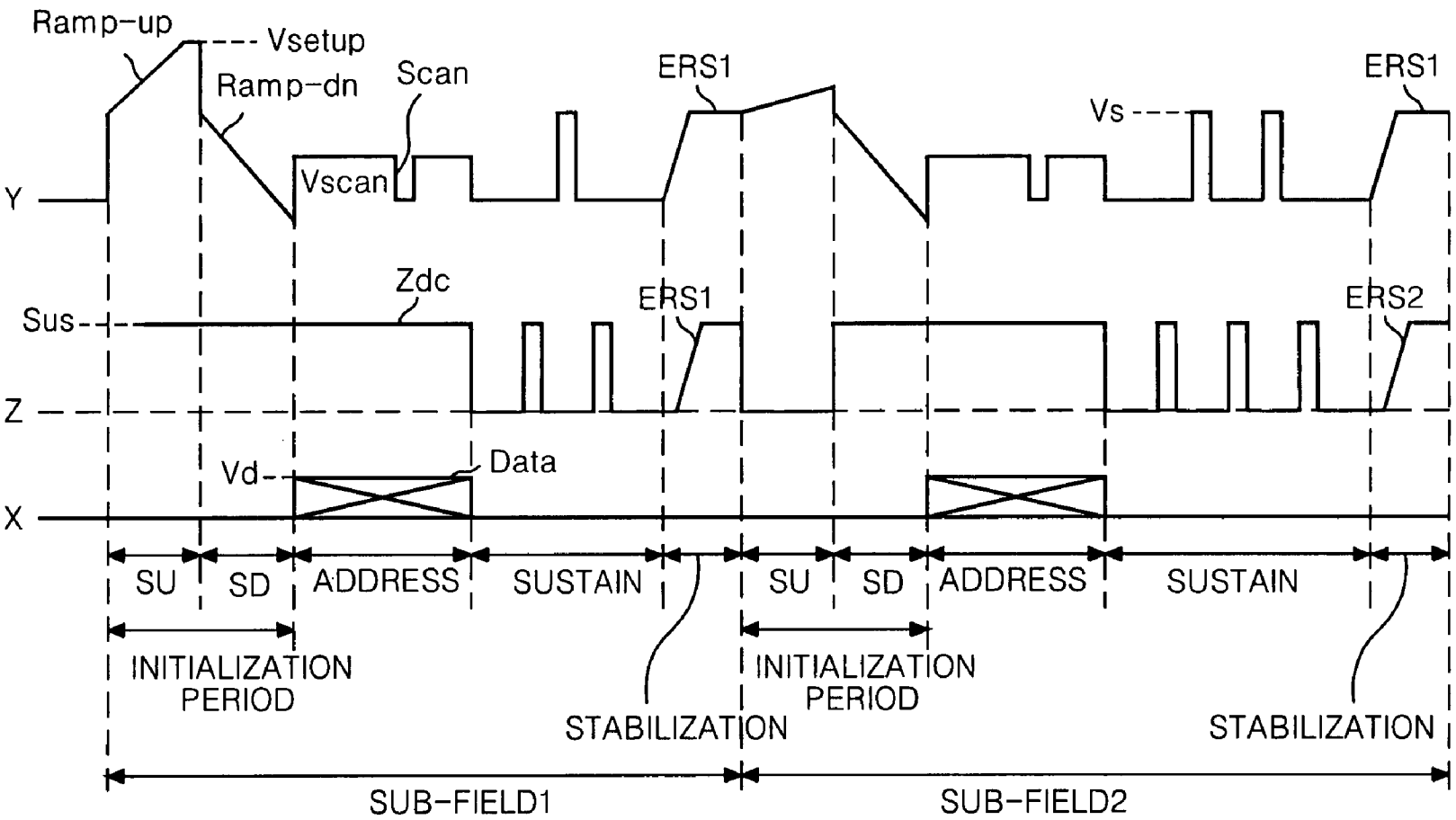
FIG. 9 is a driving waveform diagram having a selective reset pulse of the PDP according to the present invention.

In selective reset SR pulse according to the embodiment of the present invention, as shown in FIG. 9, a rising ramp waveform Ramp-up is simultaneously applied all scan electrodes Y during a set-up interval SU of a reset period. At the same time, a sustain electrode Z and an address electrode X are supplied with zero(0) V. The rising ramp waveform Ramp-up causes a set-up discharge between the scan electrodes Y and the address electrodes X, and at the same time, causes the set-up discharge between the scan electrodes Y and the sustain electrodes Z, within cells of full screen, wherein the set-up discharge is a weak discharge. By this set-up discharge, positive wall charges are accumulated on the address electrodes X and the sustain electrodes Z, and negative wall charges are accumulated on the scan electrodes Y. In a set-down interval SD of the reset period, a falling ramp waveform Ramp-down falling from about a sustain voltage Vs to the ground voltage GND or zero(0) V is simultaneously applied to all of the scan electrodes Y. While the falling ramp waveform Ramp-down is simultaneously applied to all of the scan electrodes Y, a positive sustain voltage Vs is applied to the sustain electrodes Z, and zero(0) V is applied to the address electrodes X. when the falling ramp waveform Ramp-down is applied, a set-down discharge is occurred between the scan electrodes Y and the sustain electrodes Z, and at the same time, the set-down discharge between the scan electrodes Y and the address electrode X, wherein the set-down discharge is a weak discharge. In this case, by the set-down discharge, an excessive wall charge that is unnecessary in an address discharge among the wall charges formed upon the set-up discharge is erased. Observing a change of the wall charges in the reset period, there is little the change of the wall charges on an address electrode X, whereas the negative walls charge on the scan electrodes Y are decreased. On the other hand, the positive wall charges are formed on the sustain electrodes Z upon the set-up discharge, but the negative wall charges are accumulated on the sustain electrodes Z by the amount of the decrease of the negative wall charges on a scan electrode Y upon the set-down discharge.

In the address period, a negative scan pulse scan is sequentially applied to the scan electrodes Y and, at the same time, a positive data pulse data is synchronized with the scan pulse scan to be applied to address electrodes X. A voltage difference between the scan pulse scan and the data pulse data is added to the wall voltage generated in the reset period to thereby cause an address discharge within an on-cell supplied with the data pulse data. The wall charges enough to occur the discharge when the sustain voltage Vs is applied are formed within on-cells selected by the address discharge. A positive direct current voltage Zdc is supplied to the sustain electrode Z in the address period.

In the sustain period, a sustain pulse sus is alternately applied to the scan electrodes Y and the sustain electrodes Z. As a wall voltage within the cells is added to the sustain pulse sus, the sustain discharge, that is, a display discharge occurs between the scan electrodes Y and the sustain electrodes Z in the on-cells selected by the address discharge whenever each sustain pulse SUS is applied to the cells.

After the completion of the sustain discharge, a stabilization period is followed. In the stabilization period, a first stabilization ramp waveform Ers1 is supplied to the scan electrode Y and a second stabilization ramp waveform Ers2 is supplied to the sustain electrode, to thereby stabilize the wall charges remaining within the cells of the full screen.

A method of driving the plasma display panel improving a contrast ratio by using the SR pulse, the strong discharge reset pulse, and the weak discharge reset pulse is will be described with reference to FIGS. 10 to 18.

Figure 10:
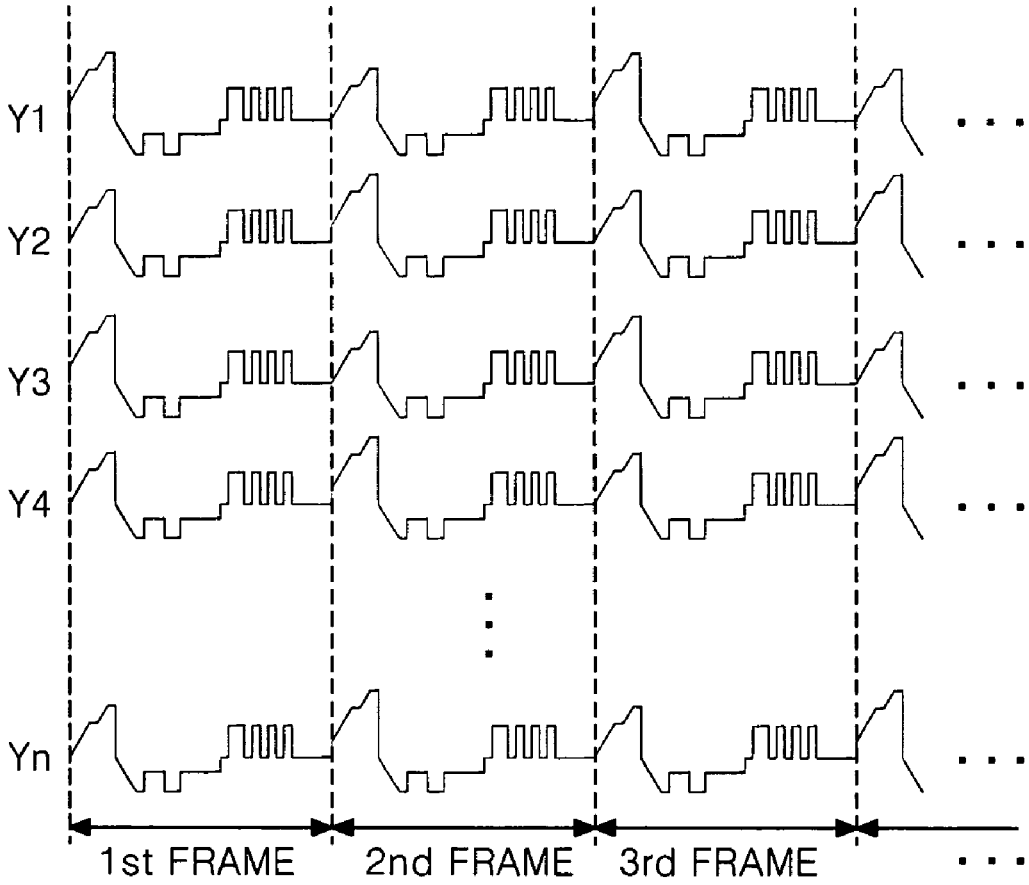
FIG. 10 is a driving waveform diagram of a PDP according to a second embodiment of the present invention.

FIG. 10 shows a waveform in accordance with a method of driving PDP using a strong discharge reset pulse and a weak discharge reset pulse according to a second embodiment of the present invention.

Referring to FIG. 10, in the method of driving the PDP according to the second embodiment of the present invention, one frame is timely divided into a plurality of sub-fields, e.x, 10 sub-fields or 12 sub-fields, to divide a scan electrode supplied to a signal into m number of blocks. For instance, When odd scan electrodes Y1, Y3, Y5, . . . are defined as a first block, even scan electrodes Y0, Y2, Y4, . . . are defined as a second block in a case that m is 2, a driving waveform including a strong discharge reset pulse is supplied to the first block during a first sub-field, and at the same time, a driving waveform including a weak discharge reset pulse is supplied to a second block. Next, while a driving waveform including a strong discharge reset pulse is supplied to the second block during a second sub-field, a driving waveform including a weak discharge reset pulse is supplied to the first block. In the same method, a driving waveform including a strong discharge reset pulse and a weak discharge reset pulse is alternatively supplied to the first and the second blocks for each sub-field. The method of driving the PDP to which such a driving waveform is applied, according to the first embodiment of the present invention acquires a high contrast ratio as compared to the method of driving the PDP to which the strong discharge reset pulse is applied for each sub-field, according to the related art.

Figure 11:
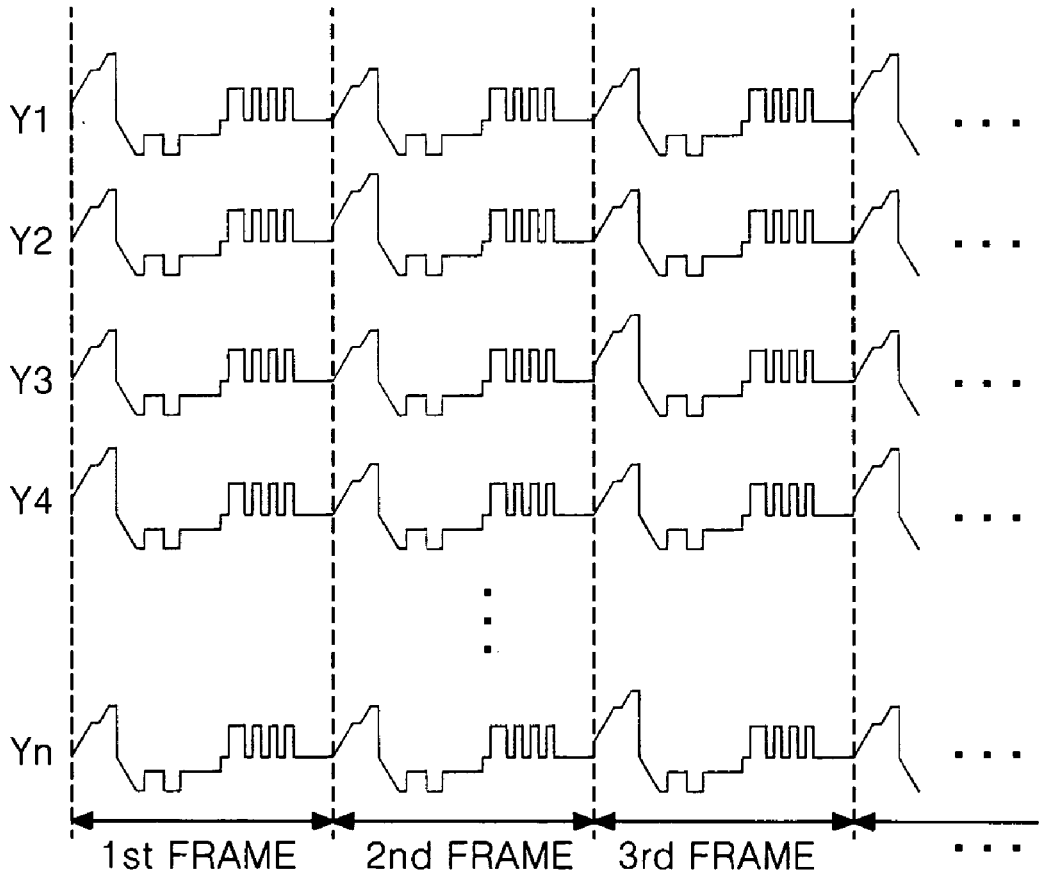
FIG. 11 is a driving waveform diagram of a PDP according to a third embodiment of the present invention.

FIG. 11 shows a waveform in accordance with a method of driving PDP using a strong discharge reset pulse and a weak discharge reset pulse according to a third embodiment of the present invention.

Referring to FIG. 11, in the method of driving the PDP according to the third embodiment of the present invention, one frame is timely divided into a plurality of sub-fields, e.x, 10 sub-fields or 12 sub-fields, to divide a scan electrode supplied to a signal into m number of blocks. For instance, When multiple of 3 including 0 scan electrodes Y3, Y6, . . . are defined as a first block, scan electrodes Y1, Y4, Y7, . . . are defined as a second block, and scan electrodes Y2, Y5, Y8, . . . are defined as a third block in a case that m is 3, a driving waveform including a strong discharge reset pulse is supplied to the first block during a first sub-field, and at the same time, a driving waveform including a weak discharge reset pulse is supplied to a second block and a third block. Next, while a driving waveform including a strong discharge reset pulse is supplied to the second block during a second sub-field, a driving waveform including a weak discharge reset pulse is supplied to the first block and the third block. Further, while a driving waveform including a strong discharge reset pulse is applied to the third block during the third sub-field period, a driving waveform including a weak discharge is supplied to the first and the second blocks. In the same method, a driving waveform including once strong reset pulse and twice weak discharge reset pulse is supplied to the first to the third blocks for every three sub-fields. The method of driving the PDP to which such a driving waveform is applied, according to the second embodiment of the present invention acquires a more improved high contrast ratio as compared to the method of driving the PDP to which the strong discharge reset pulse is applied for each sub-field, according to the related art. Herein, the driving waveform including the strong discharge pulse supplied to the first and the third blocks during the same sub-field can be supplied in a non-sequence, e.x., a sequence of the first block, the third block, and the second block. Further, the method of driving the PDP according to the embodiment of the present invention does not limit to the number of blocks. In other words, the block can be divided into 4 blocks to 7 blocks.

Figure 12:
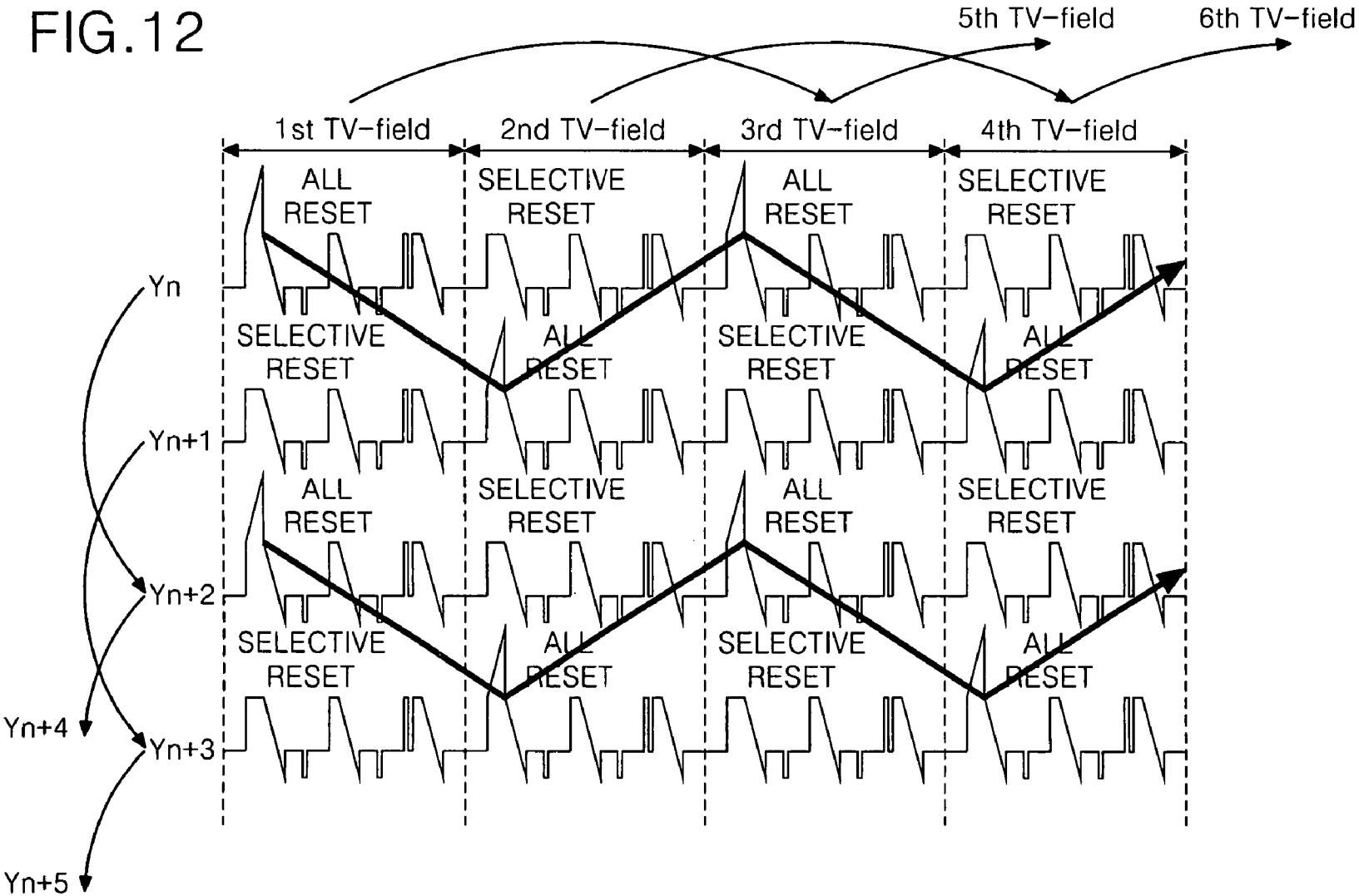
FIG. 12 is a driving waveform diagram of a PDP according to a fourth embodiment of the present invention.

FIG. 12 shows a waveform diagram in accordance with a method of driving a PDP using a strong discharge reset pulse (all reset) and a selective reset (SR) pulse according to a fourth embodiment of the present invention.

Referring to FIG. 12, in a case that m is 2, a block according to the fourth embodiment of the present invention divides scan electrodes of the entire panel into adjacent two blocks to include the entire horizontal resolution/two blocks. More specifically, in a case that odd scan electrodes Yn, Yn+1, Yn+3, Yn+5 . . . among scan electrodes Yn, Yn+1, Yn+2, Yn+3, Yn+4, Yn+5 are defined as a first block, and Yn, Yn+2, Yn+4, . . . are defined as a second block, while a driving waveform including a strong discharge reset pulse (all reset) capable of causing an initialization discharge in the entire cell during a first frame TV-field is applied to the first block, a driving waveform including a selective reset SR pulse causing a discharge in only cell turned on in just before sub-field is supplied to the second block. Next, while a driving waveform including the SR pulse is applied to the first block, a driving waveform including the strong discharge reset pulse (all reset) is applied to the second block, during a second frame TV-field. In this way, the driving pulse is alternatively applied to the first block and the second block for each frame TV-field. Herein, a driving waveform including the strong discharge reset pulse (all reset) applied to the first and the second blocks during each frame TV-field is included in more than at least one among a plurality of sub-fields included in one frame. A method supplying a driving waveform to the sub-fields can be supplied in accordance with the driving method described in the first and the second embodiments according to the present invention. For instance, in the method of driving the PDP in which one frame TV-field is timely divided into a plurality of sub-fields according to the fourth embodiment of the present invention, a strong discharge reset pulse (all reset) is applied to a first sub-field among the sub-fields of a first frame $1^{st}$ TV-field in even scan electrodes, and a weak discharge reset waveform (selective reset) is applied to the reset sub-fields. A weak discharge reset waveform (selective reset) is applied to the entire odd scan electrodes. In the next from $2^{nd}$ TV-field, a strong discharge reset waveform (all reset) is applied to any one of the rest sub-fields except for the $1^{st}$ sub-field among the sub-fields in a frame of a driving waveform applied to the odd scan electrodes, and a weak discharge reset waveform (selective reset) is applied to the reset sub-fields. In this case a weak discharge reset waveform (selective reset) is applied to the entire even scan electrodes. In this way, the strong discharge reset waveform (all reset) is alternatively applied to the even scan electrodes and the odd scan electrodes by the frame TV-field unit, and the strong discharge reset waveform (all reset) applied to each sub-field by the frame TV-field unit is non-sequentially applied to one or more sub-fields. As a result, the method of driving the PDP according to the third embodiment of the present invention reduces a supply of the strong discharge reset waveform (all reset), to thereby acquire a high contrast ratio, and non-sequentially adjusts a point of time when the strong discharge reset waveform (all reset) is applied to the sub-fields, to thereby prevent a deterioration of a picture quality such as a rippling wave pattern generable when the strong discharge reset waveform (all reset) is sequentially applied to the sub-fields.

In the driving waveform of the PDP according to the fourth embodiment of the present invention, the selective reset SR waveform is applied, so that the wall charges of the on cells can be initialized, but it is difficult to control an off cell in accordance with a surrounding condition. Accordingly, in a fifth embodiment of the present invention, a driving waveform using a weak, discharge pulse capable of acquiring a high contrast ratio and controlling both the one cell and off cell, will be suggested.

Figure 13:
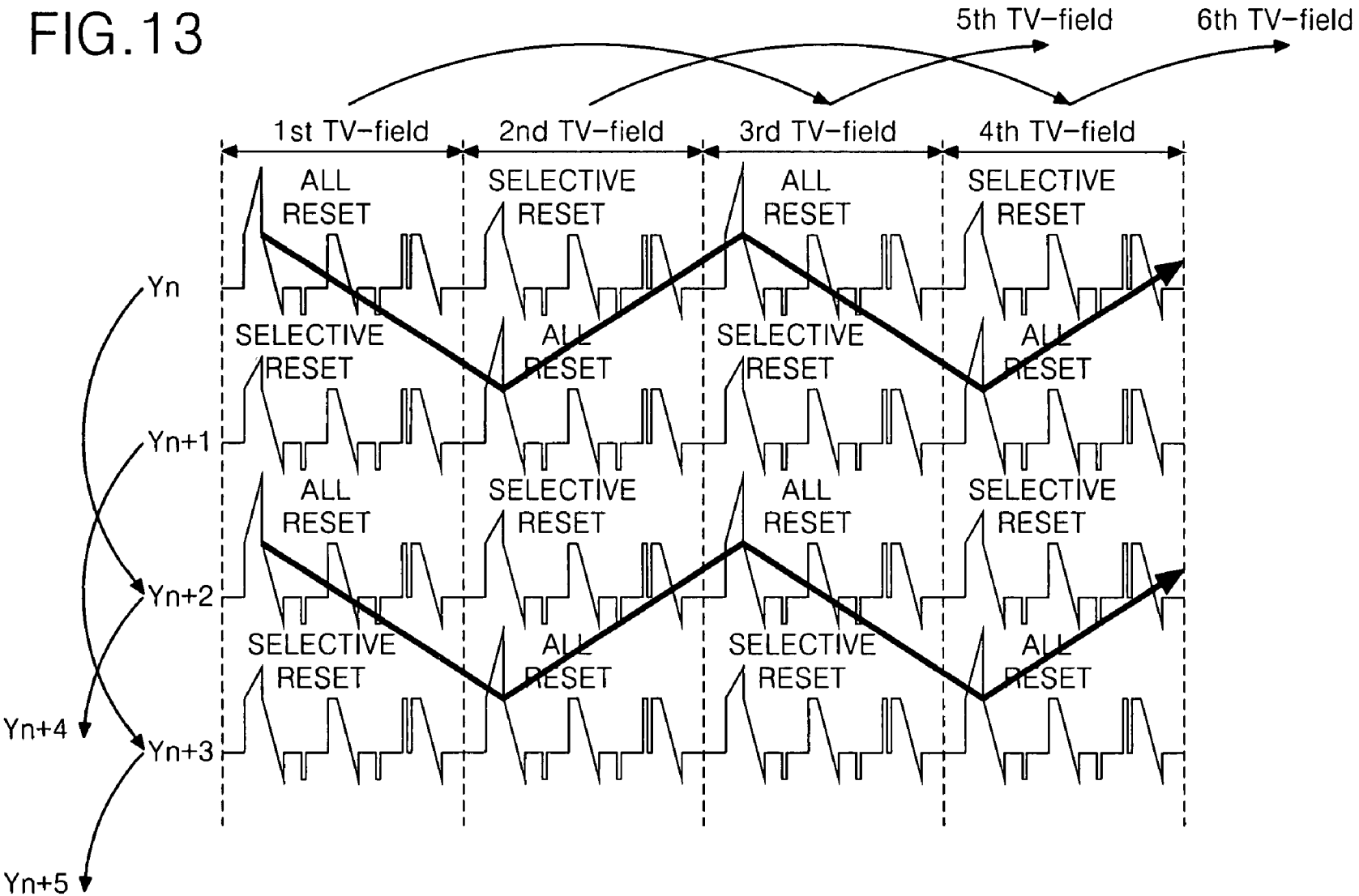
FIG. 13 is a driving waveform diagram of a PDP according to a fifth embodiment of the present invention.

FIG. 13 shows a waveform diagram in accordance with a method of driving a PDP using a strong discharge reset pulse (all reset) and a weak discharge reset pulse (small reset) according to a fifth embodiment of the present invention.

Referring to FIG. 13, in a case that m is 3, a block according to the fourth embodiment of the present invention divides scan electrodes of the entire panel into adjacent two blocks to include the entire horizontal resolution/2 number of blocks. More specifically, in a case that odd scan electrodes Yn, Yn+1, Yn+3, Yn+5 . . . among scan electrodes Yn, Yn+1, Yn+2, Yn+3, Yn+4, Yn+5 are defined as a first block, and Yn, Yn+2, Yn+4, . . . are defined as a second block, while a driving waveform including a strong discharge reset pulse (all reset) capable of causing an initialization discharge in the entire cell during a first frame TV-field is applied to the first block, a driving waveform including a weak discharge reset pulse (small reset) is supplied to the second block. Next, while a driving waveform including the weak discharge reset pulse (small reset) is applied to the first block, a driving waveform including the strong discharge reset pulse (all reset) is applied to the second block, during a second frame $2^{nd}$ TV-field. In this way, the driving pulse is alternatively applied to the first block and the second block for each frame TV-field. Herein, a driving waveform including the strong discharge reset pulse (all reset) applied to the first and the second blocks during each frame TV-field is included in more than at least one among a plurality of sub-fields included in one frame. A method supplying a driving waveform to the sub-fields can be supplied in accordance with the driving method described in the second and the third embodiments according to the present invention. In the method of driving the PDP driven by the above-mentioned method according to the fourth embodiment of the present invention, the strong discharge reset pulse (all reset) is applied fewer as compared to the second embodiment of the present invention. Accordingly, the method of driving the PDP according to the fourth embodiment of the present invention acquires more improved high contrast ratio as compared to that of the second embodiment of the present invention.

Figure 14:
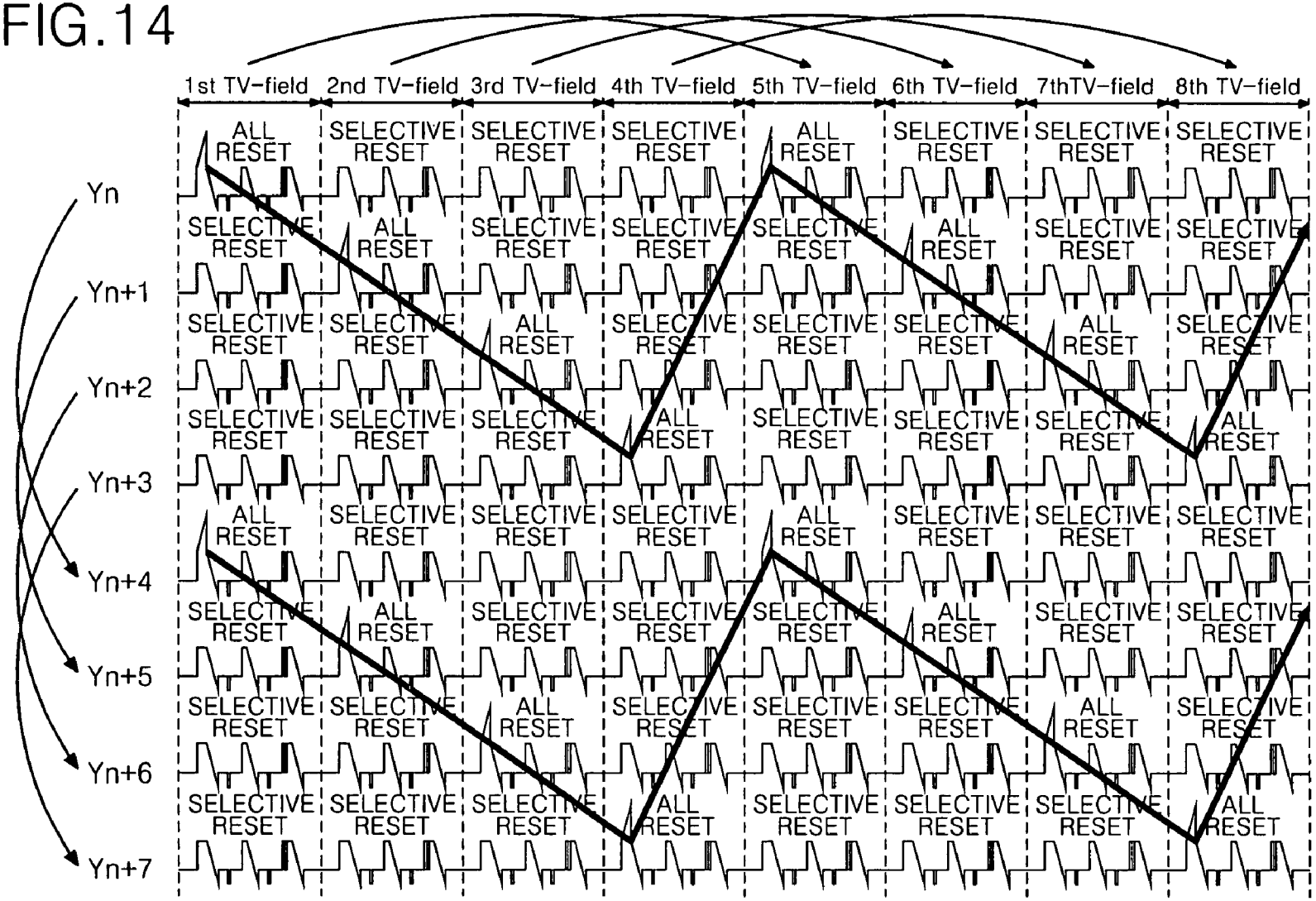
FIG. 14 is a driving waveform diagram of a PDP according to a sixth embodiment of the present invention.

FIG. 14 shows a waveform diagram in accordance with a method of driving a PDP using a strong discharge reset pulse (all reset) and a selective reset (SR) pulse according to a sixth embodiment of the present invention. Herein, the selective reset (SR) according to the sixth embodiment of the present invention can be replaced by the above-mentioned weak discharge reset pulse (small reset).

The PDP according to sixth embodiment of the present invention defines scan electrodes Yn, Yn+4, Yn+8, . . . are defined as a first block, scan electrode Yn+1, Yn+5, Yn+9, . . . as a second block, scan electrodes Yn+2, Yn+6, Yn+10, . . . as a third block, and scan electrodes Yn+3, Yn+7, Yn+11, . . . as a fourth block. In the method of driving the PDP having the first to the fourth blocks according to the sixth embodiment of the present invention, while a driving waveform including a strong reset pulse (all reset) is applied to the first block during a first frame $1^{st}$ TV-field, a driving waveform including a selective reset SR pulse replace by the strong discharge reset pulse (all reset) is applied to the reset second to fourth blocks. While a driving waveform including a strong discharge reset pulse (all reset) is applied to the second block during a second frame $2^{nd}$ TV-field, a driving waveform including a selective reset SR pulse is applied to the first block, the third block and the fourth block except for the second block. In this way, a driving waveform including a strong discharge reset pulse (all reset) is applied to the third block during a third frame $3^{rd}$ TV-field, and a driving waveform including a strong discharge reset pulse (all reset) is applied to the fourth block during a fourth frame $4^{th}$ TV-field. Thereafter, a driving waveform including a strong discharge reset pulse (all reset) is applied to the first and the fourth blocks for every four frames.

Figure 15:
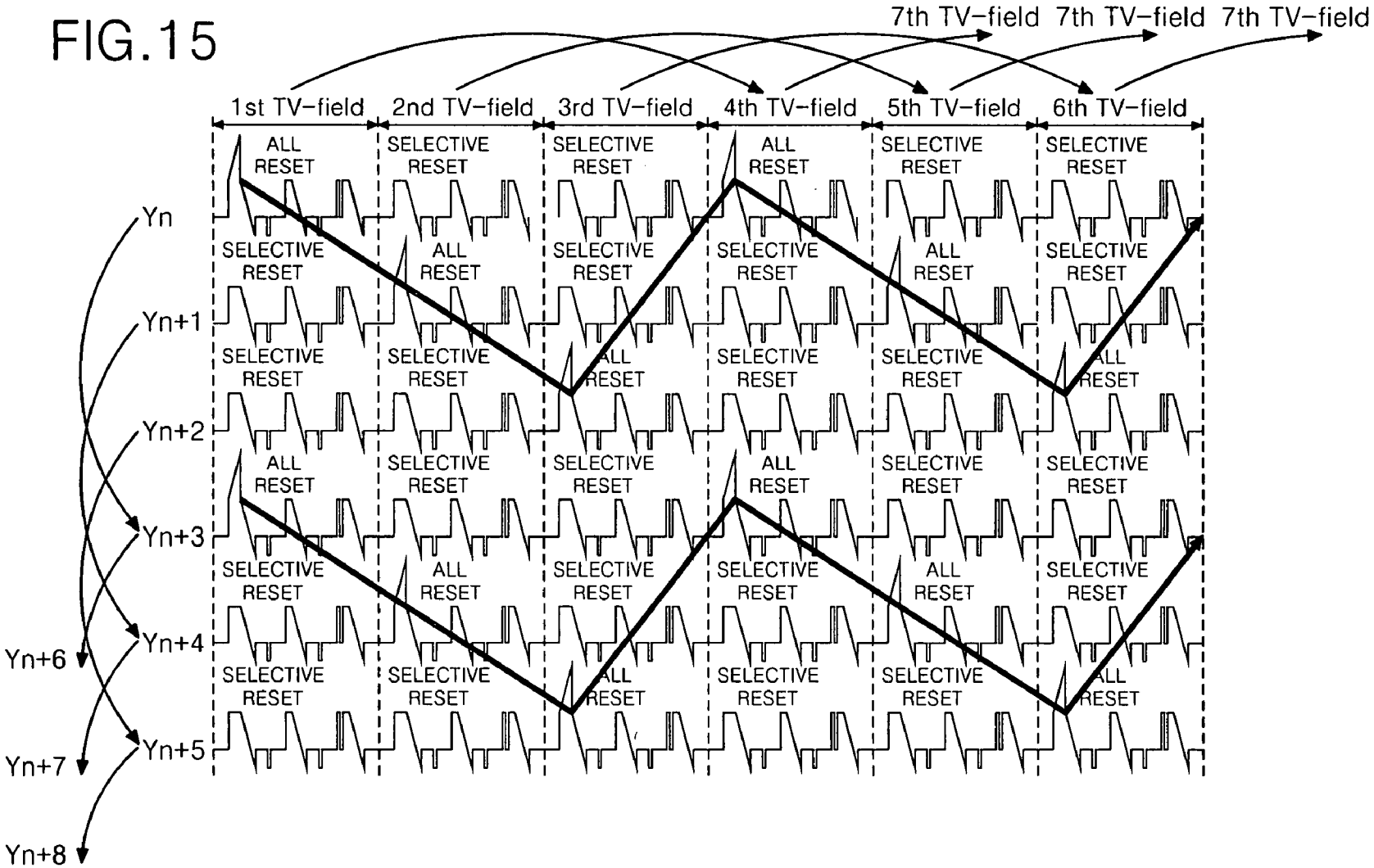
FIG. 15 is a driving waveform showing another applying method of a strong discharge reset pulse shown in FIG. 14.

A method of applying the strong discharge reset pulse (all reset) applied by the above-mentioned method according to the sixth embodiment of the present invention can be identically applied to scan electrodes, divided into first to third blocks as shown in FIG. 15. More specifically, a strong discharge reset pulse (all reset) is sequentially applied to the first block and the third block, formed by Yn to Yn+2 horizontal lines during the first frame $1^{st}$ TV-field to the third frame $3^{rd}$ TV-field. Thereafter, such a method of applying the strong discharge reset pulse (all reset) can be applied to each block formed by three horizontal lines for every three frames.

In the method of driving the PDP according to the sixth embodiment of the present invention, a driving waveform including a strong discharge reset pulse (all reset) is sequentially applied by m number of block unit (m is a natural number) for each frame TV-field. Since the driving waveform including the strong discharge reset pulse (all reset) is repeatedly applied by m number of block unit, a stripes pattern phenomenon becomes generated on the whole.

Figure 16:
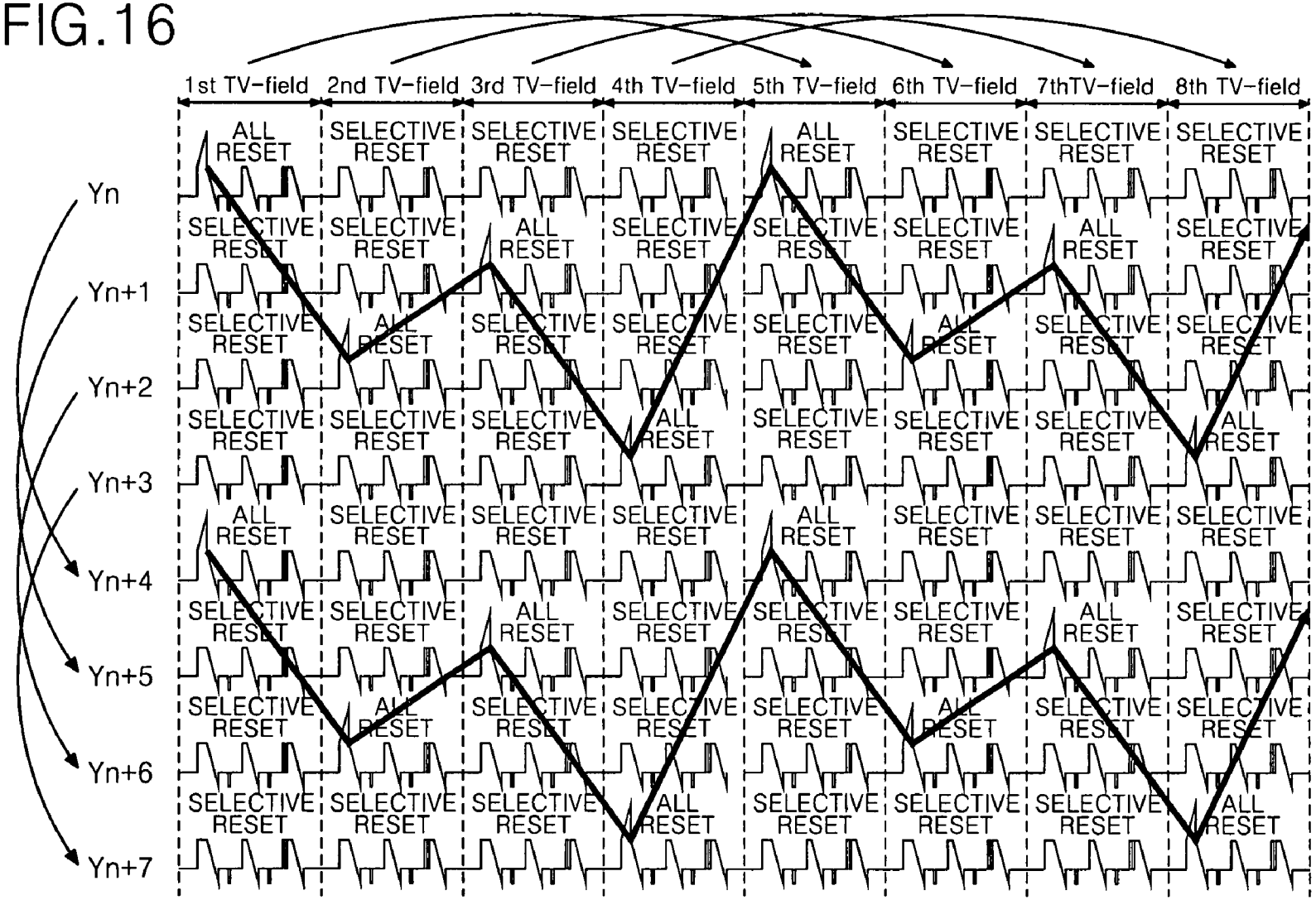
FIG. 16 is a driving waveform diagram of a PDP according to a seventh embodiment of the present invention.

FIG. 16 shows a waveform diagram in accordance with a method of driving a PDP using a strong discharge reset pulse (all reset) and a selective reset (SR) pulse according to a seventh embodiment of the present invention. Herein, the selective reset (SR) according to the seventh embodiment of the present invention can be replaced by the above-mentioned weak discharge reset pulse (small reset).

Herein, the method of driving the PDP according to the seventh embodiment of the present invention has compositions identical to those of the method of driving the PDP according to the sixth embodiment of the present invention except that a point of time of applying the driving waveform including the strong discharge reset pulse (all reset) is different. Therefore, only a point of time of applying a driving waveform will be describes as follows.

Referring to FIG. 16, in the PDP according to the seventh embodiment of the present invention, a driving waveform including a strong discharge reset pulse (all reset) is applied to a first block during a first frame $1^{st}$ TV-field, and a driving waveform including a selective reset SR pulse is applied to second to fourth block except for the first block. During next second frame $2^{nd}$ TV-field, a driving waveform including a strong discharge reset pulse (all reset) is supplied to the third block, and a driving waveform including a selective reset SR pulse is supplied to the first block, the second block, and the fourth block except for the third block. During next third frame $3^{rd}$ frame $3^{rd}$ TV-field, a driving waveform including a strong discharge reset pulse (all reset) is applied to the second block, and a driving waveform including a selective reset SR pulse is applied to the first block, the third block, and the fourth block except for the second block. During next fourth frame $4^{th}$ TV-field, a driving waveform including a strong discharge reset pulse (all reset) is supplied to the fourth block, and a driving waveform including a selective reset SR pulse is applied to the first to the third block except for the fourth block. In this way, a driving waveform including a strong discharge reset pulse (all reset) is non-sequentially applied to the first to the fourth block for every fourth frames.

Figure 17:
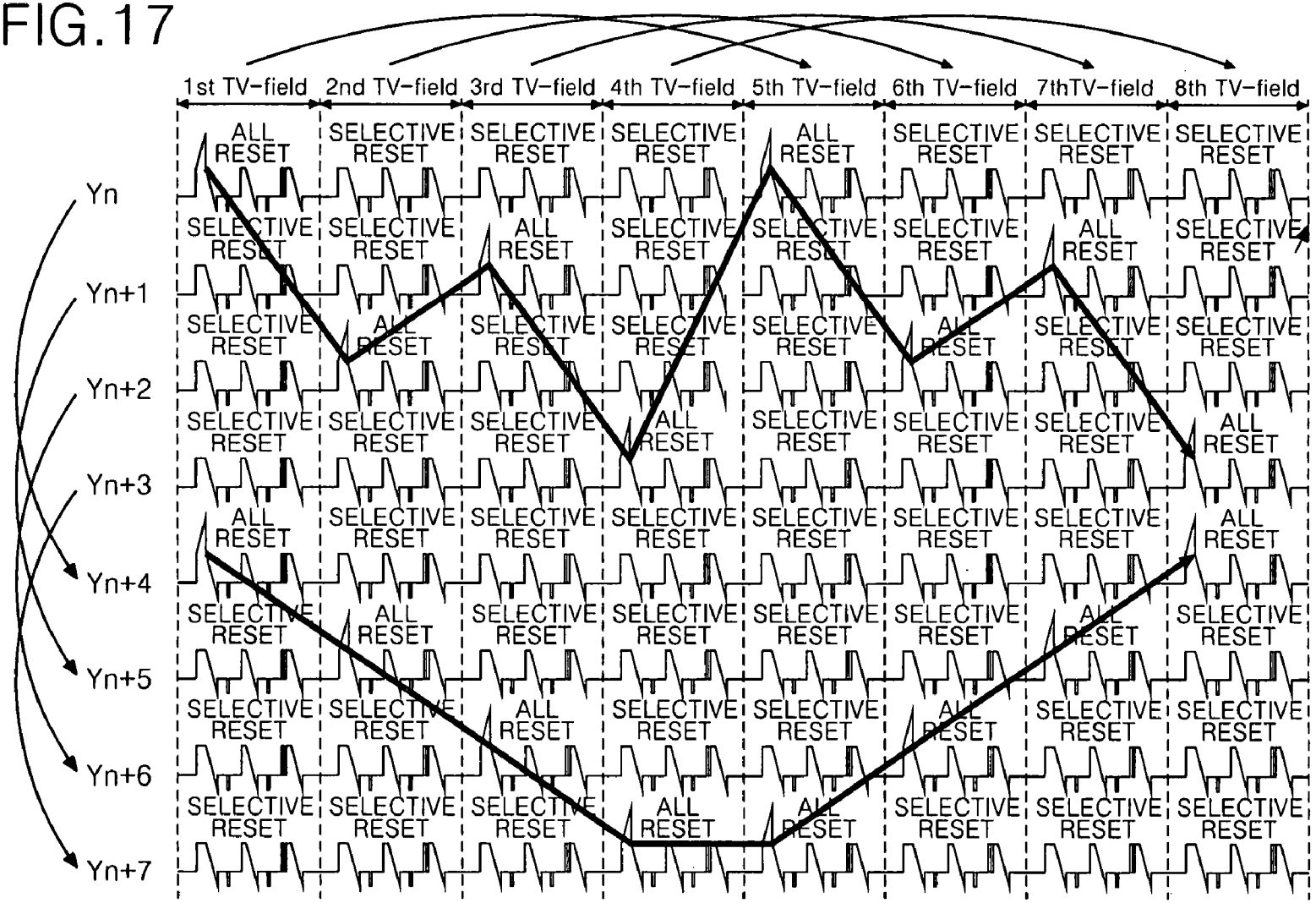
FIG. 17 is a driving waveform diagram of a PDP according to an eighth embodiment of the present invention.

FIG. 17 shows a waveform diagram in accordance with a method of driving a PDP using a strong discharge reset pulse (all reset) and a selective reset (SR) pulse according to an eighth embodiment of the present invention. Herein, the selective reset (SR) according to the eighth embodiment of the present invention can be replaced by the above-mentioned weak discharge reset pulse (small reset).

Herein, the method of driving the PDP according to the eighth embodiment of the present invention has compositions identical to those of the method of driving the PDP according to the sixth embodiment of the present invention except that a point of time of applying the driving waveform including the strong discharge reset pulse (all reset) is different. Therefore, only a point of time of applying a driving waveform will be describes as follows.

The PDP according to the eighth embodiment of the present invention includes: a first class block having Yn to Yn+3 scan electrodes of first block to fourth block; a second class block having Yn+4 to Yn+7f of the first to the fourth block; a third class block having Yn+8 to Yn+11 of the first to the fourth block; and etc. by the same number. Herein, odd-numbered class blocks, i.e., the first class block, the third class block, . . . are driven by the same method as the method of driving the PDP according to the seventh embodiment of the present invention. A description on this will be omitted. In the method of the PDP of even-numbered class blocks, i.e. the second class block, the fourth class block, . . . a driving waveform including a strong discharge reset pulse (all reset) is sequentially applied to the first block to the fourth block during a first frame $1^{st}$ TV-field to a fourth frame $4^{th}$ TV-field, and a driving waveform including a strong discharge reset pulse (all reset) is sequentially applied to the fourth block to the first block during a fifth frame $5^{th}$ TV-field to an eighth frame $8^{th}$ TV-field. Herein, a point of time supplying the driving waveform including the strong discharge reset pulse (all reset) supplied to the even-numbered class blocks is set different from a point of time supplying the driving waveform including the strong discharge reset pulse (all reset) supplied to the odd-numbered class blocks.

In a method of driving the PDP in the above-mentioned method according to the eighth embodiment of the present invention, one strong discharge reset pulse (all reset) is applied for every four frames in each horizontal line to thereby minimize a dark discharge caused by the reset pulse. Accordingly, the method of driving the PDP according to the eighth embodiment of the present invention acquires more improved high contrast ratio as compared to that of the first embodiment of the present invention.

In the method of driving the PDP according to the embodiments of the present invention, a point of time applying a driving waveform including a strong discharge reset pulse (all reset) can be variously set in accordance with a division method, the number of driving waveform including the applied strong reset pulse (all reset), and the number of sub-fields included in one frame. In the various setting, the most preferable block division of the PDP capable of substantially preventing a stripe and of reducing a miss discharge is a method which divides the scan electrodes into five blocks and seven blocks (not shown) as shown in FIG. 16 to drive them.

Figure 18:
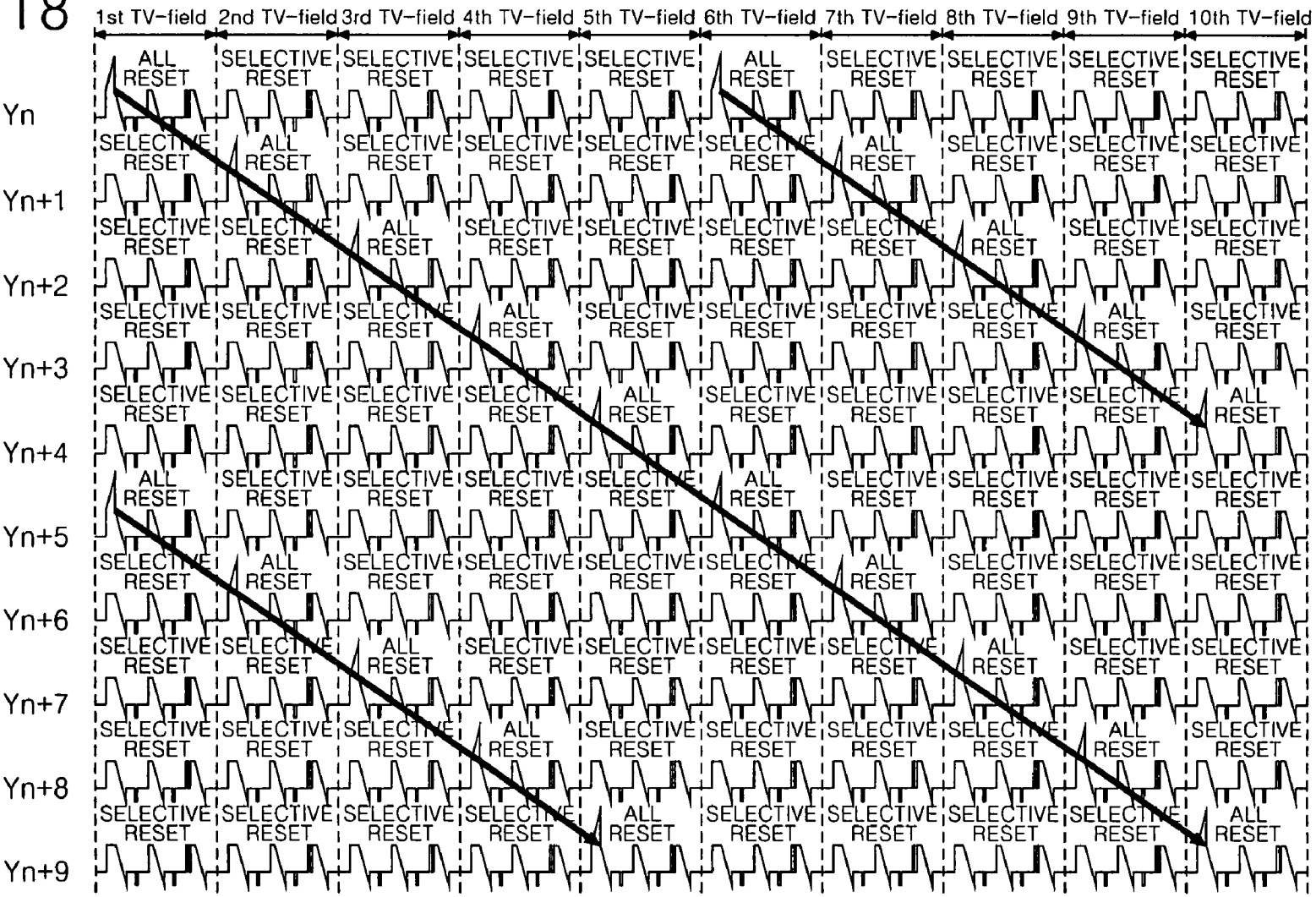
FIG. 18 is a driving waveform diagram of a PDP according to a nineteenth embodiment of the present invention.

Referring to FIG. 18, a PDP according to a ninth embodiment of the present invention defines scan electrodes Yn, Yn+4, . . . as a first block, scan electrodes Yn+1, Yn+5, . . . as a second block, Yn+2, Yn+6, . . . as a third block, scan electrodes Yn+3, Y+7, . . . as a fourth block, and scan electrodes Yn+4, Yn+8, . . . as a fifth block. While a driving waveform including a strong discharge reset pulse (all reset) is applied to the first block during a first frame $1^{st}$ TV-field, a driving waveform including a selective reset SR pulse is applied to the second block to the fifth block. Herein, in the method of driving the PDP according to the ninth embodiment of the present invention, a weak discharge reset pulse replaced by the selective reset SR pulse can be used. While a driving waveform including a strong discharge reset pulse (all reset) is applied to the second block during a second frame $2^{nd}$ TV-field, a driving waveform including a selective reset SR pulse is applied to the first block, the third to the fifth block. In the same way, while a waveform including a strong discharge reset pulse (all reset) is applied to the third to the fifth block, a driving waveform including a selective reset SR pulse is applied to the other blocks except for the third to the fifth block. Herein, it is preferable that the driving waveform, including the strong discharge reset pulse (all reset) is applied to the first block to the fifth block in a non-sequence, and further is experimentally applied in a sequence of 1-3-5-2-4.

Further, if the PDP according to the embodiment of the present invention is divided into the first block to the seventh block by the same method as the ninth embodiment of the present invention, then it is preferable that the driving waveform, including the strong discharge reset pulse (all reset) is applied to the first block to the seventh block in a non-sequence, and further, is experimentally applied in a sequence of 1-3-5-7-2-4-6.

In brief, a plurality of scan electrodes is divided into m (m is an integer more than 2) number of blocks to be driven. The p (p is a natural number more than 1) number of strong discharge reset pulses having a first voltage is applied during a sub-field of the scan electrodes included in more than one block among the m number of groups during a specific frame having ten sub-fields or twelve sub-fields, and at the same time, the q (q is a natural number more than 1) number of weak discharge reset pulses having a second voltage different from the first voltage is applied to scan electrodes included in the rest groups except for more than one block in which the strong discharge reset pulse is applied during the specific frame.

Further, in a plurality of frames, for instance, in the frame division method using 60 Hz frequencies, a driving waveform including the p number of strong discharge reset pulses is applied to more than one block for 60 frames, and a driving waveform including q number of weak discharge reset pulses is applied to the rest blocks except for the blocks in which the driving waveform including the strong discharge reset pulses is applied during the same frame. Herein, the p number of strong discharge reset pulses applied to the blocks is non-sequentially applied.

As described above, in the method of driving the PDP according to the present invention, the strong discharge reset pulse and the weak discharge reset pulse are alternately applied without changing a driving circuit. Accordingly, it is possible apply a high contrast ratio of the PDP.

Meanwhile, in briefing the block dividing method according to each embodiment of the present invention, in a plurality of scan lines, that is, Y0, Y1, Y2, Y3, Y4, Y5 . . . Yn−5, Yn−4, Yn−3, Yn−2, Yn−1, Yn, the first block dividing method is dividing the scan lines into two blocks and each block includes an even-numbered scan line and an odd-numbered scan line. The second block dividing method is dividing the scan lines into three blocks, wherein the first block includes a scan line of Y0, Y3, Y6 . . . Y(3·n), the second block includes a scan line of Y1, Y4, Y7 . . . Y(3·n+1), and the third block includes a scan line of Y2, Y5, Y8 . . . Y(3·n+2).

As described above, in the method of driving the PDP according to the present invention, the strong discharge reset pulse and the weak discharge reset pulse are alternately applied without changing a driving circuit. Accordingly, it is possible apply a high contrast ratio of the PDP.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A method of driving a plasma display device driven by dividing a plurality of scan electrode lines into the m (m is a integer more than 2) number of groups comprising:

applying p (p is a natural number more than 1) number of first reset pulse having a first voltage to the scan electrode lines included in more than one group among m number of groups during a specific frame; and simultaneously applying q (q is a natural number more than 1) number of second reset pulse having a second voltage different from the first voltage to the second electrode line included in the rest groups except for more than one group during the specific frame.

2. The method according to claim 1, wherein the p number of first reset pulse and the q number of second reset pulse are applied during a reset interval of a sub-field composing the specific frame.

3. The method according to claim 1, wherein the first reset pulse is applied to the scan electrode line included in more than one group among the m number of groups during the specific frame, the second reset pulse is applied to the scan electrode line included in the rest groups, the first reset pulse after more than one frame in the specific frame, and the first reset pulse is applied to the scan electrode line included in the group in which the second reset pulse is applied from the next frame of the specific frame.

4. The method according to claim 1, wherein the first voltage is larger than the second voltage.

5. A method of driving a plasma display panel, initializing a discharge cell by using an initializing signal for causing a set-up discharge, comprising:

applying the initializing signal of a high voltage to at least one scan electrode during one frame period; and applying the initializing signal of a low voltage to the rest scan electrodes except for the scan electrodes to which the initializing signal of the high voltage is applied during the frame period.

6. The method according to claim 5, wherein the scan electrodes to which the initializing signal of the high voltage is applied is shifted by a frame period unit.

7. The method according to claim 6, wherein the scan electrodes to which the initializing signal of the low voltage is applied is shifted by a frame period unit.

8. The method according to claim 5, wherein the initializing signal of the high voltage is applied to the same scan electrodes by a predetermined number of frame unit.

9. An apparatus of driving a plasma display panel driven by dividing a plurality of scan electrode lines into the m (m is an integer more than 2) number of groups comprising a reset driving circuit including: generating the p (p is a natural number more than 1) number of first reset pulse having a first voltage to apply them to the scan electrode lines included in more than one group among m number of groups during a specific frame; and generating the q (q is a natural number more than 1) number of second reset pulse having a second voltage different from the first voltage to apply them to the second electrode line included in the rest groups except for more than one group during the specific frame.

10. The apparatus according to claim 9, wherein the reset driving circuit supplies:

the first reset pulse to the scan electrode line, wherein a potential of the scan electrode line suddenly rises up to a scan bias voltage and then rises to up the sum of the scan bias voltage and a sustain voltage with a first inclination, and rises to the sum of the scan bias voltage Vsc, the sustain voltage Vs and a ramp voltage Vramp with a second inclination, to thereby form the first reset pulse; and the second reset pulse to the scan electrode line, wherein a potential of the scan electrode line rises up to a sustain voltage Vs with a third inclination and then rises up to the sum of the sustain voltage Vs and a ramp voltage Vramp with a fourth inclination, to thereby form the second reset pulse.

11. The apparatus according to claim 10, wherein a potential of the scan electrode line rises up to a sustain voltage Vs with a fifth inclination and maintains it during a predetermined period in the second reset pulse.

12. The apparatus according to claim 11, wherein the second reset pulse is supplied to a cell in which a discharge is generated just before sub-field.

13. The apparatus according to claim 10, wherein the reset driving circuit includes:

a sustain pulse supplier for generating a sustain pulse included in the first and the second reset pulses;

a rising ramp pulse supplier for generating a rising ramp pulse included in the first and the second reset pulses;

a falling ramp pulse supplier for generating a falling ramp pulse included in the first and the second reset pulses; and a scan bias voltage supplier for generating a scan bias voltage included in the first reset pulse.

14. The apparatus according to claim 10, wherein the first voltage is lager than the second voltage.

15. The apparatus according to claim 9, wherein the p number of first reset pulses and the q number of second reset pulses are applied during a reset interval of a sub-field composing the specific frame.

16. The apparatus according to claim 9, wherein the first reset pulse is applied to the scan electrode line included in more than one group among the m number of groups during the specific frame, the second reset pulse is applied to the scan electrode line included in the rest groups, the first reset pulse after more than one frame in the specific frame, and the first reset pulse is applied to the scan electrode line included in the group in which the second reset pulse is applied from the next frame of the specific frame.

17. The apparatus according to claim 9, wherein the reset driving circuit non-sequentially applies the first reset pulse to each block formed with first to nth scan electrode line, wherein n is a natural number.

18. The apparatus according to claim 9, wherein the reset driving circuit repeatedly applies the first reset pulse, applied to each block formed with first to nth scan electrode line, by n number of frames unit.

19. The apparatus according to claim 9, wherein the reset driving circuit non-sequentially applies the first reset pulse to the sub-fields different from each other included in each frame, wherein the non-sequential applying method is periodically repeated.

* * * * *